US010974298B2

(12) United States Patent
Smith et al.

(10) Patent No.: US 10,974,298 B2
(45) **Date of Patent: *Apr. 13, 2021**

(54) TAPERED STRUCTURE CONSTRUCTION

(71) Applicant: Keystone Tower Systems, Inc., Denver, CO (US)

(72) Inventors: Eric D. Smith, Denver, CO (US); Rosalind K. Takata, Denver, CO (US); Alexander H. Slocum, Bow, NH (US); Samir A. Nayfeh, Shrewsbury, MA (US)

(73) Assignee: KEYSTONE TOWER SYSTEMS, INC., Denver, CO (US)

( * ) Notice: Subject to any disclaimer, the term of this patent is extended or adjusted under 35 U.S.C. 154(b) by 540 days.

This patent is subject to a terminal disclaimer.

(21) Appl. No.: 15/851,472

(22) Filed: Dec. 21, 2017

(65) Prior Publication Data

US 2018/0133769 A1 May 17, 2018

Related U.S. Application Data

(63) Continuation of application No. 14/978,175, filed on Dec. 22, 2015, now Pat. No. 10,195,653, which is a continuation of application No. 13/623,817, filed on Sep. 20, 2012, now Pat. No. 9,302,303.

(60) Provisional application No. 61/537,013, filed on Sep. 20, 2011.

(51) Int. Cl.

| | |
|---|---|
| ***B21B 39/02*** | (2006.01) |
| ***B21C 37/12*** | (2006.01) |
| ***B21C 37/18*** | (2006.01) |

(52) U.S. Cl.

CPC ..... *B21B 39/02* (2013.01); *B21C 37/124* (2013.01); *B21C 37/126* (2013.01); *B21C 37/185* (2013.01)

(58) Field of Classification Search

CPC ..... B21B 39/02; B21C 37/185; B21C 37/126; B21C 37/124

See application file for complete search history.

(56) References Cited

U.S. PATENT DOCUMENTS

| | | | |
|---|---|---|---|
| 1,498,176 | A | 6/1924 | Lachman |
| 1,659,792 | A | 2/1928 | Thorsby et al. |
| 2,054,153 | A | 9/1936 | Awbrey |
| 2,355,707 | A | 8/1944 | De Boer et al. |
| 2,412,678 | A | 12/1946 | Goldman |
| 2,567,020 | A | 9/1951 | Kueter |
| 2,584,074 | A | 1/1952 | Wilkins et al. |

(Continued)

FOREIGN PATENT DOCUMENTS

| | | |
|---|---|---|
| CN | 85105639 | 1/1987 |
| CN | 1091062 | 8/1994 |

(Continued)

OTHER PUBLICATIONS

USPTO, "U.S. Appl. No. 16/208,831 Non-Final Office Action dated Oct. 3, 2019", 12 pages.

(Continued)

*Primary Examiner* — Teresa M Ekiert

(74) *Attorney, Agent, or Firm* — The Marbury Law Group, PLLC

(57) ABSTRACT

Feeding stock used to form a tapered structure into a curving device such that each point on the stock undergoes rotational motion about a peak location of the tapered structure; and the stock meets a predecessor portion of stock along one or more adjacent edges.

13 Claims, 21 Drawing Sheets

(56) References Cited

U.S. PATENT DOCUMENTS

| | | | |
|---|---|---|---|
| 2,593,714 | A | 4/1952 | Robinson et al. |
| 2,706,851 | A | 4/1955 | Stout et al. |
| 2,991,740 | A | 7/1961 | Eckhardt |
| 3,227,345 | A | 1/1966 | Vilem |
| 3,300,042 | A | 1/1967 | Gordon |
| 3,332,265 | A | 7/1967 | Colas |
| 3,407,639 | A | 10/1968 | Kehne |
| 3,472,053 | A | 10/1969 | Chang |
| 3,606,783 | A | 9/1971 | Lewis |
| 3,650,015 | A | 3/1972 | Davis |
| 3,775,835 | A | 12/1973 | Cauffiel et al. |
| 3,776,010 | A | 12/1973 | Krakow |
| 3,808,862 | A | 5/1974 | Tanaka et al. |
| 3,888,283 | A | 6/1975 | Cauffiel |
| 3,991,597 | A | 11/1976 | Krakow et al. |
| 4,082,211 | A | 4/1978 | Embury |
| 4,147,454 | A | 4/1979 | Willums et al. |
| 4,261,931 | A | 4/1981 | Rothrock et al. |
| 4,367,640 | A | 1/1983 | Heitzman et al. |
| 4,438,643 | A | 3/1984 | Menzel et al. |
| 4,640,453 | A | 2/1987 | Oe et al. |
| 4,927,050 | A | 5/1990 | Palazzo et al. |
| 4,945,363 | A | 7/1990 | Hoffman |
| 5,063,969 | A | 11/1991 | Snyder et al. |
| 5,139,603 | A | 8/1992 | Kunz et al. |
| 5,301,869 | A | 4/1994 | Toyooka et al. |
| 5,326,410 | A | 7/1994 | Boyles |
| 5,573,716 | A | 11/1996 | Jacobson |
| 5,862,694 | A | 1/1999 | Horning |
| 5,865,053 | A | 2/1999 | Abbey, III et al. |
| 5,868,888 | A | 2/1999 | Don et al. |
| 6,306,235 | B1 | 10/2001 | Henderson |
| 6,339,945 | B2 | 1/2002 | Miller et al. |
| 6,533,749 | B1 | 3/2003 | Mitusina et al. |
| 6,732,906 | B2 | 5/2004 | Andersen |
| 6,964,141 | B2 | 11/2005 | Igarashi |
| 7,739,843 | B2 | 6/2010 | Cortina-Cordero |
| 7,802,412 | B2 | 9/2010 | Jensen |
| 8,146,320 | B2 | 4/2012 | Seidel et al. |
| 8,196,358 | B2 | 6/2012 | Shiraishi |
| 8,590,276 | B2 | 11/2013 | Kryger et al. |
| 8,636,196 | B2 | 1/2014 | Hill et al. |
| 9,168,576 | B2 | 10/2015 | Unan |
| 2001/0018839 | A1 | 9/2001 | Miller et al. |
| 2007/0245789 | A1 | 10/2007 | Zepp et al. |
| 2007/0294955 | A1 | 12/2007 | Sportel |
| 2009/0021019 | A1 | 1/2009 | Thomsen |
| 2009/0165518 | A1 | 7/2009 | Booth |
| 2009/0188207 | A1 | 7/2009 | Gordin et al. |
| 2009/0320542 | A1 | 12/2009 | Kephart et al. |
| 2010/0095508 | A1 | 4/2010 | Wahlen et al. |
| 2011/0179623 | A1 | 7/2011 | Smith et al. |
| 2012/0029294 | A1 | 2/2012 | Smith |
| 2012/0273556 | A1 | 11/2012 | Unan et al. |
| 2013/0074564 | A1 | 3/2013 | Smith et al. |
| 2014/0220371 | A1 | 8/2014 | Smith et al. |
| 2015/0273550 | A1 | 10/2015 | Takata |
| 2016/0107213 | A1 | 4/2016 | Smith et al. |
| 2019/0063101 | A1 | 2/2019 | Smith et al. |
| 2019/0119344 | A1 | 4/2019 | Takata et al. |

FOREIGN PATENT DOCUMENTS

| | | |
|---|---|---|
| CN | 2848445 | 12/2006 |
| CN | 201613273 | 10/2010 |
| CN | 203343212 | 12/2013 |
| DE | 1075530 | 2/1960 |
| EP | 0013870 | 8/1980 |
| GB | 1041159 | 9/1966 |
| GB | 1075548 | 7/1967 |
| JP | 427145 | 3/1967 |
| JP | 4431455 | 12/1969 |
| JP | S5870918 | 4/1983 |
| JP | S5956934 | 4/1984 |
| JP | 01278911 | 11/1989 |
| JP | 1278911 | 11/1989 |
| WO | WO2013043920 | 3/2013 |
| WO | WO-2015148756 | 10/2015 |

OTHER PUBLICATIONS

EPO, "EP Application Serial No. 19190631.2 Search Report dated Sep. 6, 2019", 5 pages.

"How to lay out sprial-formed Welded tapered cylinders" by A.A. Pfeifer; Product Engineering; Apr. 15, 1963, Apr. 15, 1963 , pp. 88-90.

"U.S. Appl. No. 13/623,817 Final Office Action dated Dec. 10, 2014", 11 pages.

USPTO, "U.S. Appl. No. 13/623,817 Non-Final Office Action dated Apr. 8, 2015", 12 pages.

USPTO, "U.S. Appl. No. 13/623,817 Non-Final Office Action dated Jul. 18, 2014", 15 pages.

USPTO, "U.S. Appl. No. 13/623,817 Notice of Allowance dated Sep. 25, 2015", 9 pages.

USPTO, "U.S. Appl. No. 14/247,856 Notice of Allowance dated Jun. 27, 2016", NPL-18 , 9.

USPTO, "U.S. Appl. No. 14/978,175 Notice of Allowance dated Nov. 8, 2017", 10 pages.

USPTO, "U.S. Appl. No. 15/276,042 Non-Final Office Action dated Sep. 25, 2017", 9 pages.

USPTO, "U.S. Appl. No. 12/693,369 Final Office Action dated Aug. 2, 2013", 10 pages.

USPTO, "U.S. Appl. No. 12/693,369 Non-Final Office Action dated Jul. 13, 2012", 10 pages.

USPTO, "U.S. Appl. No. 12/693,369 Notice of Allowance dated Dec. 26, 2013", 8 pages.

USPTO, "U.S. Appl. No. 12/693,369, Non-Final Office Action dated Nov. 7, 2012", 7 pages.

USPTO, "U.S. Appl. No. 14/228,481, Final Office Action dated Nov. 3, 2016", 14 pages.

USPTO, "U.S. Appl. No. 14/228,481, Non-Final Office Action dated May 18, 2016", 16 pages.

USPTO, "U.S. Appl. No. 14/247,856 Non-Final Office Action dated Mar. 28, 2016", 10 pages.

USPTO, "U.S. Appl. No. 14/228,481, Non-Final Office Action dated Aug. 31, 2017", 15 pages.

USPTO, "U.S. Appl. No. 14/978,175, Non-Final Office Action dated Jan. 27, 2017", 15 pages.

USPTO, "U.S. Appl. No. 14/978,175, Notice of Allowance dated May 17, 2017", 5 pages.

AUSPAT, "AU Application No. 2012312351 First Office Action dated Aug. 8, 2016", 2 pages.

CIPO, "CN Application No. 201280056927.6 Office Action dated May 18, 2017", English and Chinese Translations, 15 pages.

CIPO, "CN Application No. 201280056927.6 Office Action dated Nov. 6, 2017", English and Chinese translations, 16 Pages.

CIPO, "CN Application No. 201280056927.6 Office Action dated Dec. 3, 2015", English and Chinese translations, 21 pages.

EPO, "EP Application No. 12833030.5 Examination Report dated Oct. 30, 2017", 7 pages.

EPO, "EP Application Serial No. 12833030.5, EP Supplemental Search Report dated Feb. 12, 2016", 7 pages.

EPO, "EP Application Serial No. 15767860.8 Supplemental Search Report dated Nov. 7, 2017", 8 pages.

International Searchingauthority, "International Application Serial No. PCT/US12056414, Preliminary Report on Patenability dated Apr. 3, 2014", 6 pages.

ISA, "International Application Serial No. PCT/US15/22648, Search Report and Written Opinion dated Aug. 12, 2015", NPL-6 , 12 pages.

JPO, "JP Application No. 2014-531976 Office Action dated Aug. 16, 2016", Japanese Translations and English Translations NPL-16 , 6 pages.

International Searchingauthority, "PCT Application No. PCT/US12/56414 International Search Report and Written Opinion dated Dec. 14, 2012", 7 pages.

(56) References Cited

OTHER PUBLICATIONS

WIPO, "PCT Application No. PCT/US15/22648 International Preliminary Report on Patentability dated Oct. 13, 2016", 9 pages.
CNIPA, "CN Application No. 201280056927.6 Notification of ReExamination dated May 20, 2019", English and Chinese Translations , 14 pages.
CNIPA, "CN Application No. 201580028200.0 Second Office Action dated Apr. 15, 2019", English and Chinese Translations , 28 pages.
USPTO, "U.S. Appl. No. 15/276,042 Notice of Allowance dated Apr. 27, 2018", 5 pages.
CIPO, "CA Application No. 2,849,300 Examination Report dated May 11, 2018", 3 pages.
China Patent Office, "CN Application No. 201280056927.6 Decision on Rejection dated Jun. 4, 2018", English and Chinese, 19 pages.
USPTO, "U.S. Appl. No. 14/228,481 Notice of Allowance dated Feb. 1, 2018", 15 pages.
USPTO, "U.S. Appl. No. 14/978,175 Non-Final Office Action dated Mar. 9, 2018", 15 pages.
IP AUS, "AU Application No. 2017200527 Examination Report dated Feb. 5, 2018", 3 pages.
JPO, "JP Application No. 2016-242956 First Office Action dated Jan. 23, 2018", English and Japanese translation, 5 pages.
IP Australia, "AU Application Serial No. 2018203517 Examination Report dated Jun. 18, 2019", 2 pages.
KIPO, "KR Application Serial No. 10-2019-7008024 Office Action dated May 20, 2019", English and Korean translations , 5 pages.
IP Australia, "AU Application Serial No. 2015236028, Examination Report dated Aug. 10, 2018", NPL-49 , 3 pages.
CIPO, "CN Application No. 201580028200.0 First Office Action dated Jul. 24, 2018", English and Chinese Translations, 22 pages.
KIPO, "KR Application Serial No. 10-2014-7008301 Office Action dated Aug. 24, 2018", English and Korean translations, 11 pages.
USPTO, "U.S. Appl. No. 14/228,481 Notice of Allowance dated Oct. 12, 2018", 9 pages.
USPTO, "U.S. Appl. No. 14/978,175 Notice of Allowance dated Oct. 22, 2018", 5 pages.
IP Australia, "AU Application Serial No. 2015236028, Examination Report dated Aug. 10, 2018", 3 pages.
CIPO, "CN Application No. 201580028200.0 First Office Action dated Jul. 24, 2018", English and Chinese Translations, 25 pages.
CNIPA, "CN Application No. 201580028200.0 Third Office Action dated Sep. 19, 2019", English and Chinese translations, 21 pages.
CNIPA, "CN Application No. 201811092830.6 Office Action dated Oct. 28, 2019", English and Chinese translations, 15 pages.
EPO, "EP Application Serial No. 15767860.8 Examination Report dated Nov. 22, 2019", 3 pages.
CIPO, "CA Application No. 2,849,300 Examiners Report dated Mar. 18, 2019", 4 pages.
IPO, "IN Application No. 2359/CHENP/2014 First Examination Report dated Feb. 25, 2019", 7 pages.
Examination Search Report for Canadian Patent Application No. 3049376, dated Oct. 6, 2020, 4 pages.
USPTO, "U.S. Appl. No. 16/208,831 Final Office Action dated Apr. 9, 2020", 11 pages.
IP Australia, "AU Application Serial No. 2019202930 Examination Report dated Apr. 29, 2020", 3 pages.
CNIPA, "CN Appln Serial No. 201811092830.6 Office Action dated Apr. 2, 2020", English and Chinese Translations , 16 pages.
IMPI, "MX Appln Serial No. MX/a/2016/012710 Office Action dated Mar. 17, 2020", English and Mexican Translations , 7 pages.
National Intellectual Property Administration, P. R. China; First Office Action for Chinese Application No. 201911152400.3, dated Nov. 4, 2020; 7 pages.

100

TAPERED STRUCTURE CONSTRUCTION

CROSS-REFERENCE TO RELATED APPLICATIONS

This application is a continuation of U.S. patent application Ser. No. 14/978,175 filed on Dec. 22, 2015, which is a continuation of U.S. patent application Ser. No. 13/623,817 filed on Sep. 20, 2012 (now U.S. Pat. No. 9,302,303), which claims the benefit of U.S. Provisional App. No. 61/537,013 filed on Sep. 20, 2011, where the entirety of each of the foregoing applications is hereby incorporated by reference.

GOVERNMENT LICENSE RIGHTS

This invention was made with government support under Grant #DE-SC0006380 awarded by Department of Energy. The government has certain rights in the invention.

TECHNICAL FIELD

This document relates to constructing tapered structures.

BACKGROUND

Various techniques and devices exist that can produce tapered structures, such as cones or frusto-conical structures. One general approach to constructing tapered structures involves bending or otherwise deforming metal stock in desired ways, then either joining the stock either to itself at certain points, or joining the stock to other structures at certain points. Some construction techniques begin with planar metallic stock, and introduce in-plane deformations (i.e., compression) to shape the stock appropriately for building the structure. These in-plane deformations often require a relatively large amount of energy, and thus increase the cost of producing structures using those techniques.

SUMMARY

A device for fabricating a frusto-conical structure from segments of planar stock are described. The frusto-conical structure may have a virtual peak located at a point where a taper of the frusto-conical structure would decrease to zero if the frusto-conical structure were not truncated. The device may include a source of a stock in planar form having a first edge and a second edge, a curving device operable to impart a controllable curvature to the stock without imparting in-plane deformation, and a feed system operable to transport the stock from the source to the curving device in a feed direction, where the feed system varyies an in-feed position of the stock so that the stock exits the curving device with the first edge at a position adjacent to the second edge of a prior portion of the stock curved by the curving device. The device may further include a joiner operable to join the first edge to the second edge at the position, and a control system to control operation of the curving device, the feed system, and the joiner to form planar metal stock from the source into the frusto-conical structure.

In general, in one aspect, feeding stock used to form a tapered structure into a curving device such that: each point on the stock undergoes rotational motion about a peak location of the tapered structure; and the stock meets a predecessor portion of stock along one or more adjacent edges.

Implementations may have one or more of the following features. The peak location moves along a fixed axis. The stock is trapezoidal. The curving device includes a triple roll. Feeding the stock into the curving device does not impart in-plane deformation to the stock. Also joining the stock to the predecessor portion along the one or more adjacent edges. Joining the stock includes completing a technique selected from the group consisting of: welding, applying an adhesive, and applying a mechanical fastener. Feeding the stock into the curving device includes varying an in-feed angle of the stock with respect to a feed direction such that each point on the stock translates tangentially to a corresponding imaginary circle of constant radius centered at the peak location. Varying the in-feed angle includes imparting at least one of a rotational motion and a translational motion to the stock relative to the feed direction.

In general, in another aspect, a system includes: a triple roll configured to impart a controllable degree of curvature to stock; a feed system capable of: imparting a first translational motion component to the stock at a first point on the stock; imparting a second translational motion component to the stock at a second point on the stock; and rotating the stock about a point on the feed system.

Implementations may have one or more of the following systems. The system also includes a control system configured to cause: the feed system to feed stock to the triple roll such that the stock undergoes rotational motion about a peak of a frusto-conical structure; and the triple roll to impart a degree of curvature to the stock that varies with time. The feed system also includes: a roller operable to feed the stock to the triple roll along the feed direction, and a positioner operable to translate the stock in the direction different from the feed direction. The feed system includes a pair of differentially driven rollers collectively operable to rotate the stock about the movable pivot and to translate the stock in the feed direction. The triple roll includes a pair of differentially driven rollers collectively operable to rotate the stock about the movable pivot and to translate the stock in the feed direction. The feed system includes a pair of positioners that are collectively operable to translate the stock to the triple roll along the feed direction, rotate the stock about the movable pivot, and translate the stock in the direction different from the feed direction. The feed system includes a pair of pickers that are collectively operable to translate the stock to the triple roll along the feed direction, rotate the stock about the movable pivot, and translate the stock in the direction different from the feed direction. A location of the peak moves relative to the triple roll while stock is fed through the triple roll.

In general, in another aspect, a system includes a triple roll configured to impart a controllable degree of curvature to stock; means for feeding stock through the triple roll via rotational motion about a peak of a frusto-conical structure;

Implementations may have one or more of the following features. A location of the peak moves relative to the triple roll while stock is fed through the triple roll.

Other implementations of any of the foregoing aspects can be expressed in various forms, including methods, systems, apparatuses, devices, computer program products, products by processes, or other forms. Other advantages will be apparent from the following figures and description.

DESCRIPTION OF DRAWINGS

Embodiments of the invention described herein may be understood by reference to the following figures, which are provided by way of example and not of limitation.

Like references numbers refer to like structures.

DETAILED DESCRIPTION

It is often desirable to form a tapered structure, such as a conical or frusto-conical structure, from a substantially planar metallic stock without introducing in-plane deformation to the stock. For example, U.S. patent application Ser. No. 12/693,369, entitled "TAPERED SPIRAL WELDED STRUCTURE," discusses some applications of such structures. The entirety of U.S. patent application Ser. No. 12/693,369 is incorporated by reference to the present document. Among other things, the techniques described below can be used to construct structures described in U.S. patent application Ser. No. 12/693,369.

Figure 1:
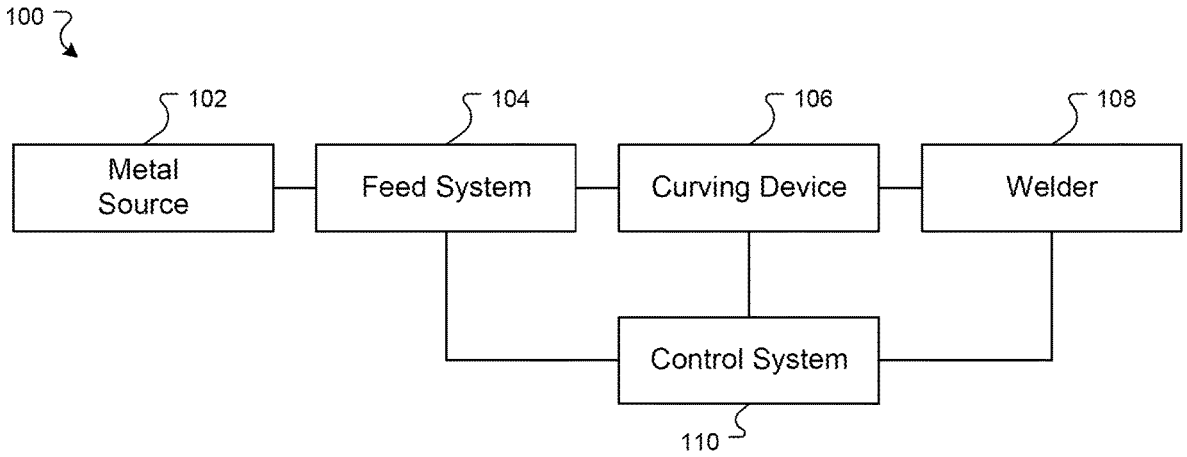
FIG. 1 is a block diagram of a construction system.

FIG. 1 is a block diagram of a construction system. The system 100 includes a metal source 102, feed system 104, a curving device 106, a welder 108, and a control system 110. As described more fully below, the system 100 is operable to construct tapered structures.

The metal source 102 includes the raw metal from which a tapered structure is formed. In some implementations, the metal source 102 can include a collection of planar metal sheets, dimensioned in any of the ways described in U.S. patent application Ser. No. 12/693,369. The sheets can be constructed and arranged to facilitate easily picking a desired sheet in the manufacturing process. For example, the sheets can be stored in a magazine or other suitable dispenser.

The feed system 104 is operable to transport metal from the metal source 102 to (and in some implementations, through) the curving device 106. The feed system 104 can include any such appropriate equipment for picking a desired sheet according to traditional techniques. Such equipment can include, for example, robotic arms, pistons, servos, screws, actuators, rollers, drivers, electromagnets, etc., or combinations of any of the foregoing.

In an alternative embodiment, the metal source 102 includes a roll of metal stock, and the system 100 includes a cutting tool 103. In operation, the cutting tool 103 cuts sections from the metal stock as described in U.S. patent application Ser. No. 12/693,369 to form a collection of sheets that can be fed into the curving device 106 by the feed system 104.

Figure 2:
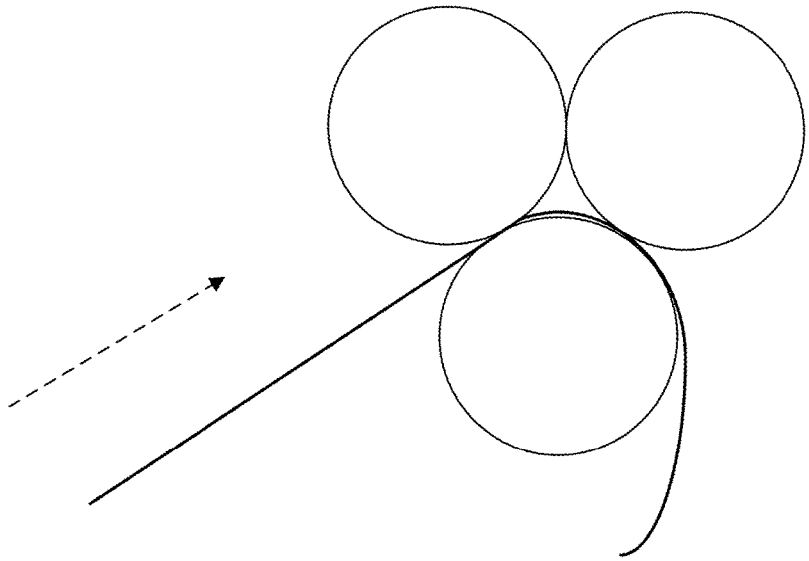
FIG. 2 is a schematic depiction of a triple roll.

The curving device 106 is operable to curve the metal fed into it, without imparting any in-plane deformation to the metal. Moreover, the curving device 106 can impart a controllable degree of curvature to the metal. In some implementations, the curving device 106 includes a triple roll. Referring to FIG. 2, a triple roll includes three parallel cylindrical rollers operable to impart a constant curvature to metal fed through the rollers in the direction of the dashed arrow. The degree of curvature can be controlled by, e.g., dynamically adjusting the radius of one or more rolls, dynamically adjusting the relative positions of the rolls, etc.

Referring back to FIG. 1, alternatively or additionally, the curving device 106 may include one or more cone-shaped rolls instead of a cylindrical roll in the triple roll configuration. A cone-shaped roll inherently imparts a varying curvature—i.e., higher curvature towards the apex of the cone, lower curvature towards the base. As a further alternative, one may use a possibly irregularly-shaped roll to impart a corresponding curvature to in-fed stock.

Additionally or alternatively to the above, a solid structure may be replaced by a collection of smaller structures (e.g., wheels, bearings, smaller rollers, or the like) that collectively approximate the exterior of the corresponding solid structure. For example, a cylinder can be replaced by a collection of wheels of equal radii, a cone could be replaced by a collection of wheels of decreasing radii, etc.

Figure 3:
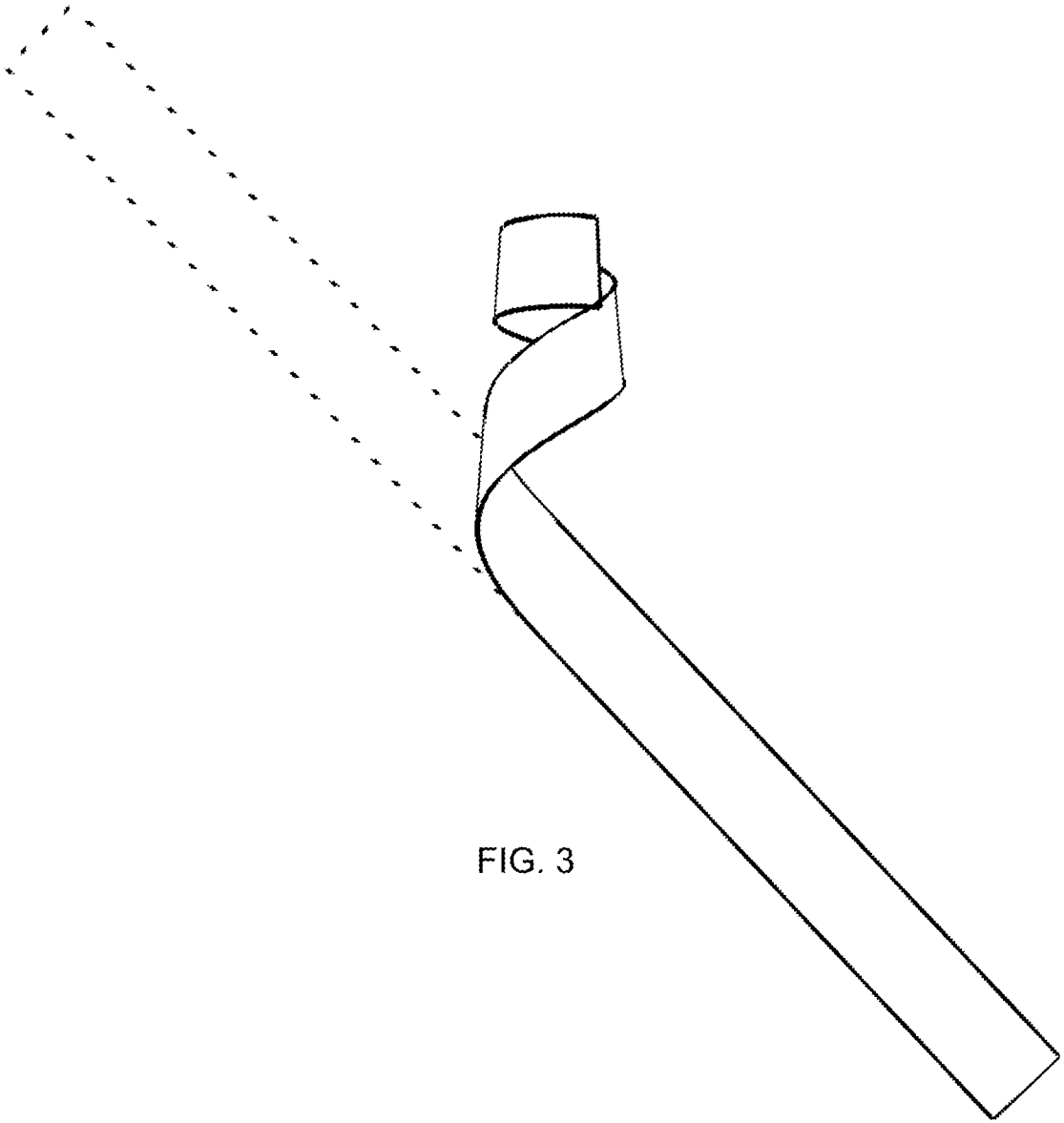
FIGS. 3-5 are schematic illustrations of deformed stock.
Figure 4:
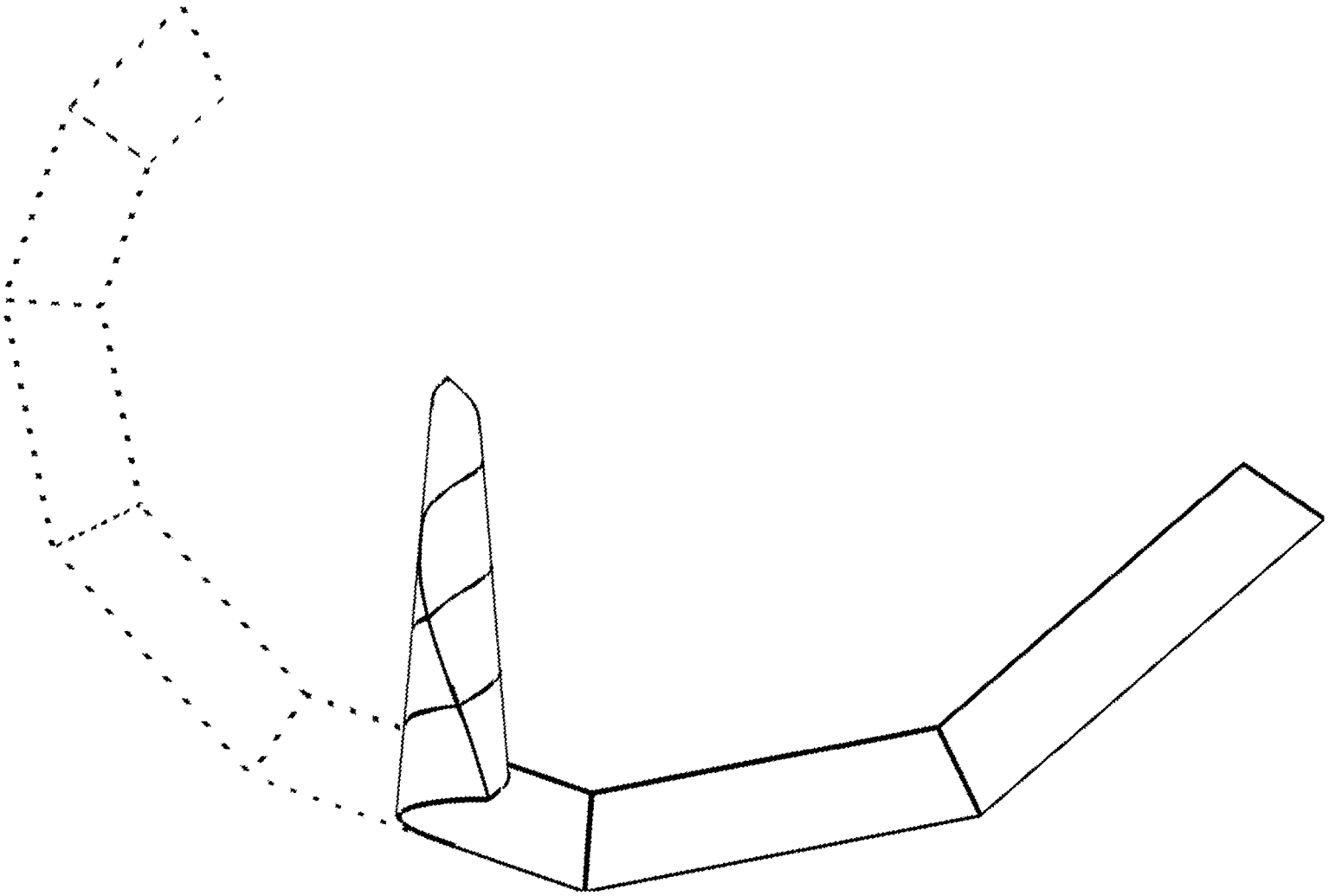

When rectangular piece of stock is fed into a triple roll "head on," (that is, with the incoming edge of the rectangular stock parallel with the axes of the triple roll's cylinders), then it will be deformed into circular arc, as illustrated in FIG. 2. However, when a rectangular piece of stock is fed in at an angle, the stock will be deformed into a "corkscrew" shape, potentially with gaps between each turn, as illustrated in FIG. 3. The techniques described below involve varying the in-feed angle (and other parameters described below) such that the edges of the stock lie adjacent to each other, allowing them to be joined (e.g., welded) to form the desired structure, as shown in FIG. 4.

One way to accomplish this is as follows. As a preliminary matter, any tapered structure includes either an actual peak or a virtual peak. An actual peak is a point at which the taper eventually decreases to zero. For example, a cone has an actual peak at its apex. For a truncated structure, such a frusto-conical structure, a "virtual peak" is the point at which the taper would eventually decrease to zero if the structure were not truncated. In this document, the word "peak" includes both actual peaks and virtual peaks.

Figure 5:
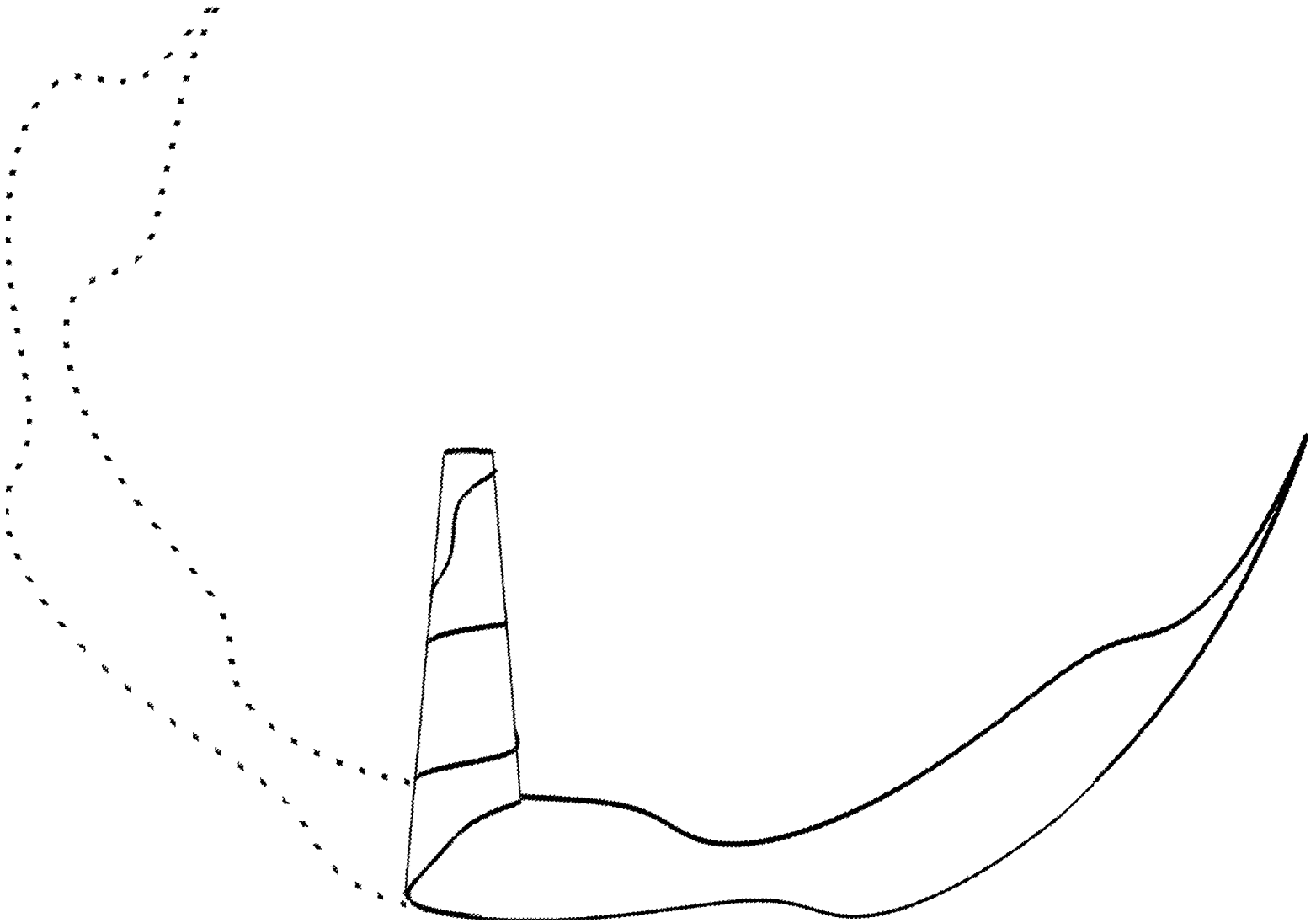

One way to vary the in-feed angle described above is to control the approach of the metal stock so that the stock is purely rotating (i.e., not translating) with respect to the peak of the structure as the stock is fed into the curving device 106. This condition is equivalent to requiring that each point on the in-coming sheet of stock be at a constant distance from the peak of the structure as the stock is deformed by the curving device 106. Note, however, that the peak of the structure itself might be moving relative to other parts of the system 100, as described more fully below. The "purely rotational" condition described above concerns only the relative motion of the in-fed stock with respect to the peak's location. That is, both the stock and the peak may also be translating or undergoing more complicated motion with respect to other components of the system 100. If this condition is met, then even irregularly shaped metallic stock can be joined into a tapered structure, as shown in FIG. 5.

In some implementations, the feed system includes one or more positioners, carriages, articulating arms, or the like, that feed each sheet of stock to the curving device and are collectively controllable by the control system 110 to ensure this in-feed condition is met.

In addition to controlling the in-feed angle, the degree of imparted curvature from the curving device is also controlled. To form a conical or frusto-conical structure, for example, the curvature with which a given point on the in-coming stock is deformed varies linearly with the height along the resultant cone's axis at which the given point will lie. Other tapered structures require other degrees of imparted curvature.

The welder 108 is operable to join sheets of in-fed stock to other sheets of in-fed stock (or to itself, or to other structures). In some implementations, the welder 108 includes one or more weld heads whose position and operation is controllable.

The control system 110 is operable to control and coordinate the various tasks described above, including but not limited to operating the feed system 104, operating the curving device 106, and operating the welder 108. The control system 110 includes computer hardware, software, circuitry, or the like that collectively generate and deliver control signals to the components described above to accomplish the desired tasks.

Thus, consistent with the above, a method for constructing a tapered structure includes: identifying stock (e.g., a sheet of stock); transporting the stock to a curving device; identifying the peak location of the tapered structure (which may change as a function of time); feeding the stock into the curving device such that the stock undergoes purely rotational motion relative to the peak location; and welding the stock along edges where the stock meets prior sheets of stock, thereby forming the tapered structure.

In the foregoing, various tasks have been described that involve relative motion of various components. However, it is recognized that varying design constraints may call for certain components to remain fixed (relative to the ground) or to undergo only minimal motion. For example, the system 100 can be designed such that any one of the following components remains fixed relative to the ground: the metal source 102, any desired component of the feed system 104, any desired component of the curving device 106, any desired component of the welder 108, the peak of the tapered structure under construction, etc. Similarly, the system 100 can be designed such that none of the above components remain fixed relative to the ground (or, except as noted above, relative to each other). In some implementations, the heaviest or hardest to move component remains fixed relative to the ground. In some implementations, the relative motion of the components is chosen to best mitigate the risk of injury to those near the system 100. In some implementations, the relative motion of the components is chosen to maximize the expected life of the system 100 as a whole or the expected life of one or more components.

As discussed above, it is desirable to arrange for entire sheet of stock being fed into system 100 to undergo purely rotational motion during the in-feed process—i.e., the period from just before the first point of the stock is fed into the curving device, up until just after the last point of the stock leaves the curving device. Achieving this condition during the in-feed process results in the edges of stock ultimately lying adjacent to corresponding edges of predecessor stock that has previously been fed through the curving device. This condition is illustrated further in FIGS. 6A-C, in the context of constructing a frusto-conical structure. The partially formed frusto-conical structure 600 has a (virtual) peak at point P, and sides tangent to the dashed lines. To more clearly illustrate the "purely rotational motion" condition, the construction system 100 is not shown.

Figure 6A:
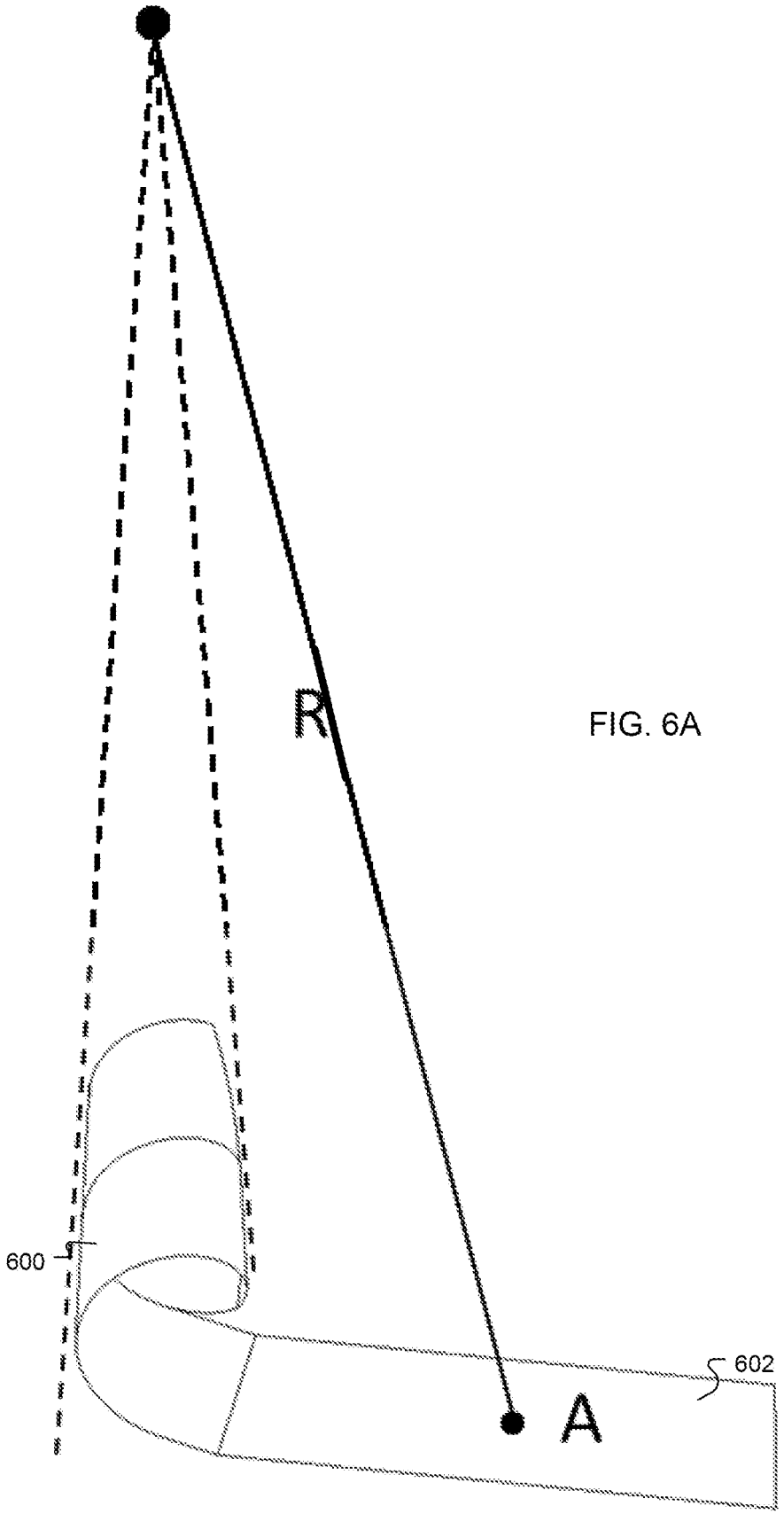
FIGS. 6A-C are schematic illustrations of stock undergoing rotational motion about a peak.
Figure 6B:
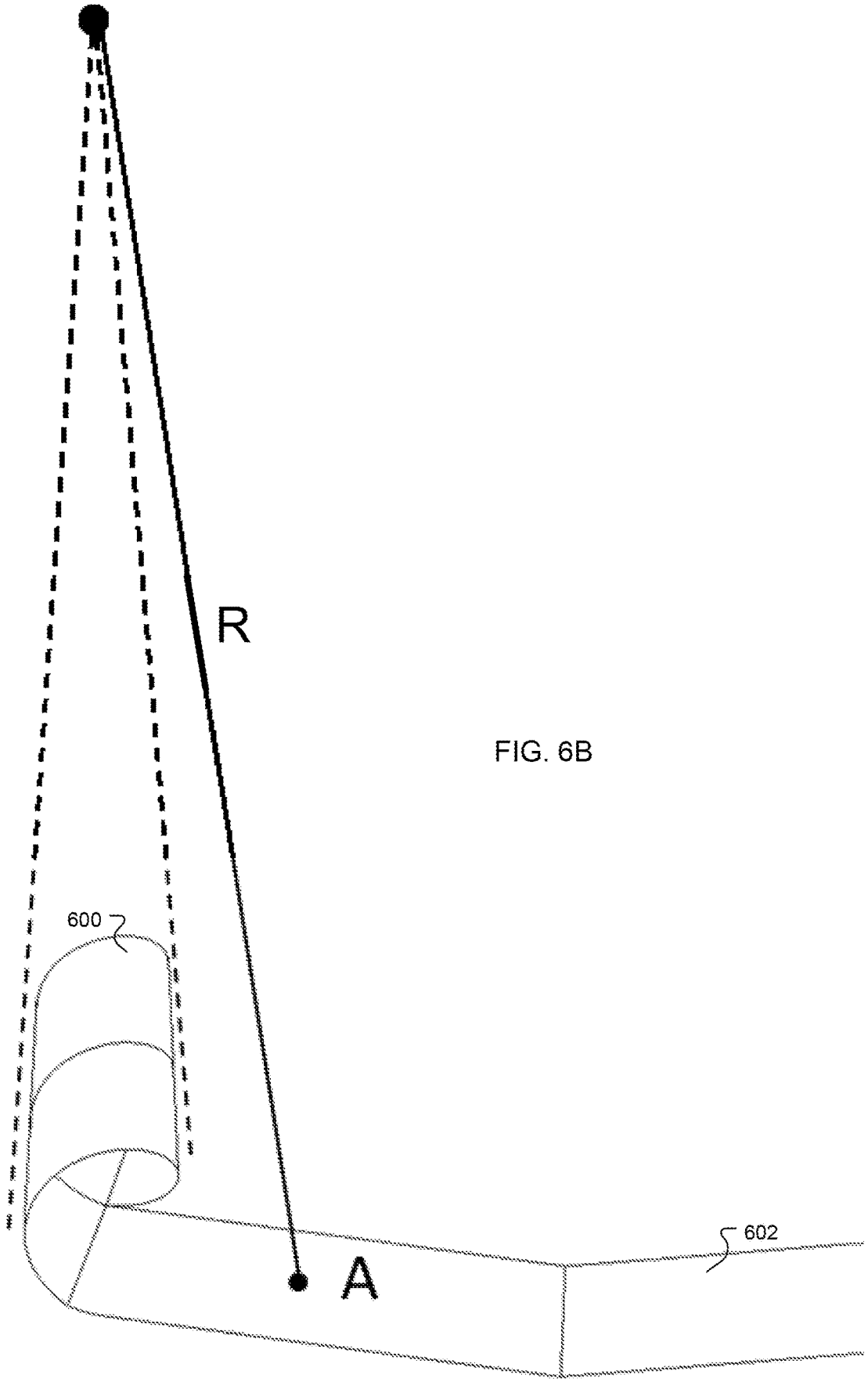
Figure 6C:
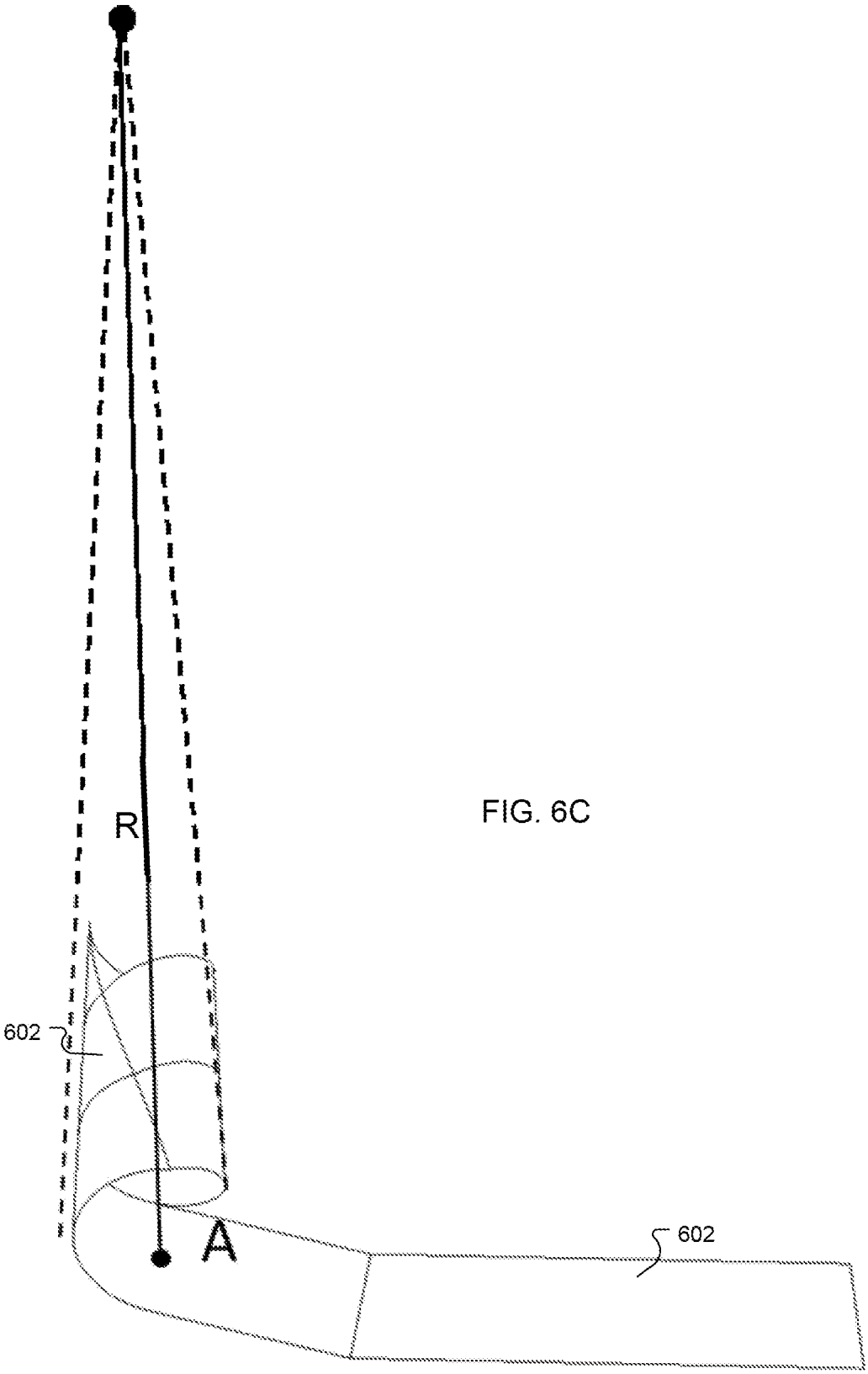

In FIGS. 6A and B, a sheet of stock 602 is shown, and an arbitrary point thereon labeled "A." The distance between the point A and the virtual peak P is labeled by the solid line R. As the sheet 602 is fed into the system, as shown in FIG. 6C, the distance R between the point A and the peak P remains constant, even as sheet 602 is deformed by the curving device of the system 100. Of course, the distance from the sheet 602 to the peak P will vary amongst points of the sheet 602. However, if the sheet 602 undergoes purely rotational motion with respect to the point P, then for any fixed point on the sheet 602, the distance from that point to the point P remains constant, even as the sheet 602 is deformed.

Figure 6D:
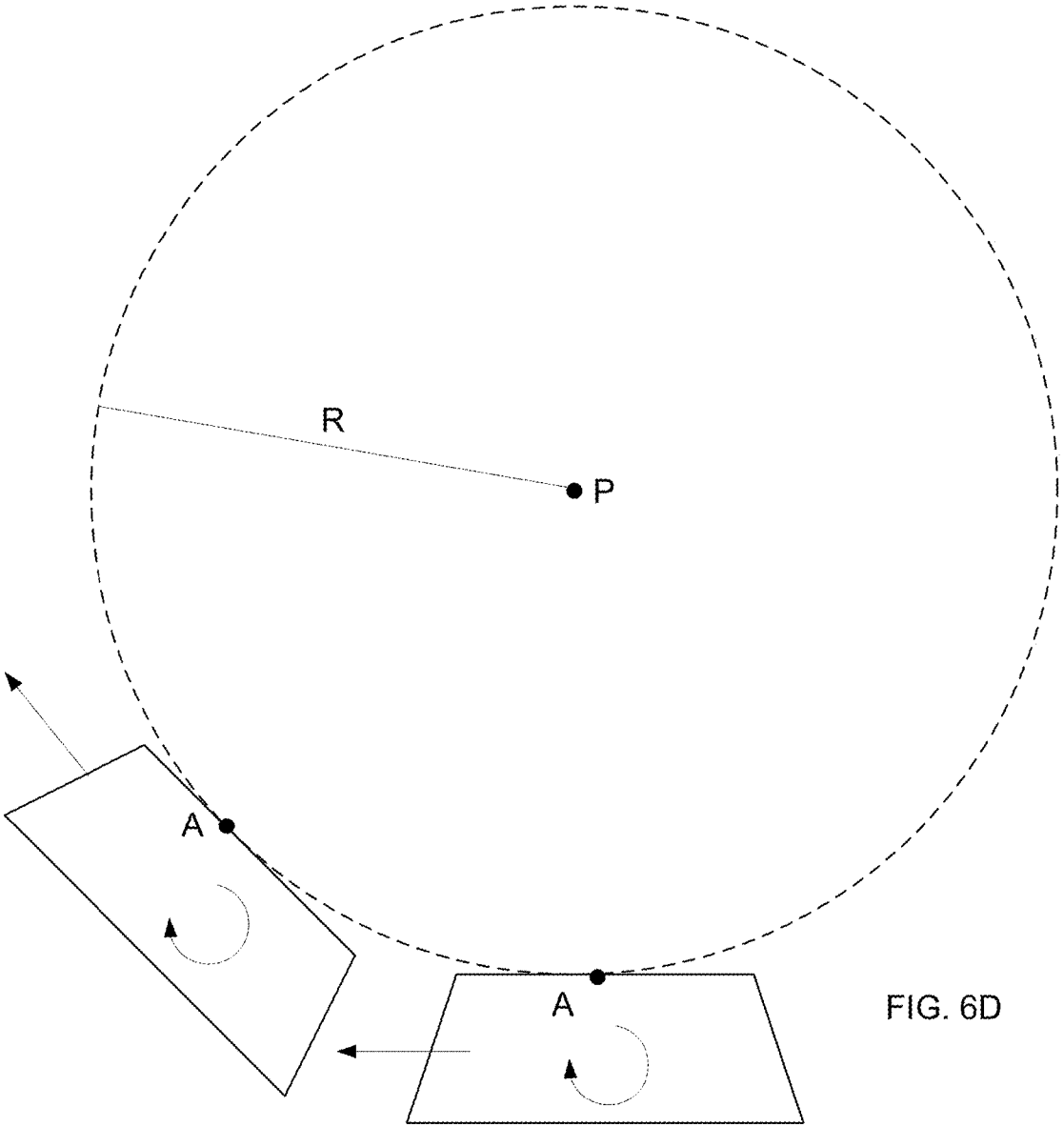
FIG. 6D is a kinematic diagram illustrating rotational motion of stock about a point.

FIG. 6D is a kinematic diagram illustrating rotational motion of stock about a point P. In FIG. 6D, an arbitrary point A is identified on the stock, and that point A maintains a constant distance R from P as the stock rotates about point P. Regardless of an equipment configuration, implementing the rotational motion can initially be thought of as requiring certain ingredients: first, the ability to impart tangential translation along the circle of radius R centered at P; and second, the ability to impart rotation in the appropriate direction about the geometric center of the stock.

Moreover, since the tangential direction changes as the stock moves, implementing this aspect of the rotational motion is possible if one can implement translation in two fixed directions (e.g., a feed direction and another direction), so long as the directions are different. If this is possible, then an arbitrary translation can be achieved by an appropriate linear combination of the fixed directions.

The foregoing description of the purely rotational condition has been set forth in the context of a stationary peak P. However, in some implementations, the point P may move during the construction process. For example, if the curving device 106 is fixed relative to the ground, then each new addition of stock may push the point P further away from the curving device. When the point P is moving in a certain direction at a certain time, the stock should also move in the same direction at the same time, in addition to having a pure rotational component, in order to satisfy the "pure rotation" condition.

Although the phrase "purely rotational" motion has been used above, slight deviations from pure rotation (i.e., slight translations of the stock or peak relative to each other) may be permissible. If the stock undergoes any translational motion with respect to the peak during the in-feed process, the resultant structure may deviate from an ideal frusto-conical geometry. In particular, there may be gaps where the stock fails to meet corresponding edges of predecessor portions of stock, the stock may overlap itself, or both.

In some implementations, a certain degree of deviation from an ideal frusto-conical structure may be tolerable. For example, if edges of stock are to be joined by welding, caulking, epoxy, or the like, then a slight gap to accommodate the weld or adhesive may be desirable. Similarly, if the edges of stock are to be joined by rivets, bolts, screws, or other mechanical fasteners, adhesives, or the like, then a slight degree of overlap may be desirable.

As used in this document, "substantially rotational" motion means purely rotational motion as described above, except allowing for slight deviations that may be useful later in the manufacturing process. The degree of these permissible deviations, in general, will vary with the dimensions of the desired frusto-conical structure and the manufacturing steps that the deviations accommodate. Also as used in this document, "rotational motion" should be understood to mean either substantially rotational motion or purely rotational motion. Conversely, if the motion of stock bears a rotational component about the peak P as well as a significant translational component beyond what is necessary or desirable for later manufacturing steps, such motion is not "rotational about the peak" within the meaning of this document.

Figure 7A:
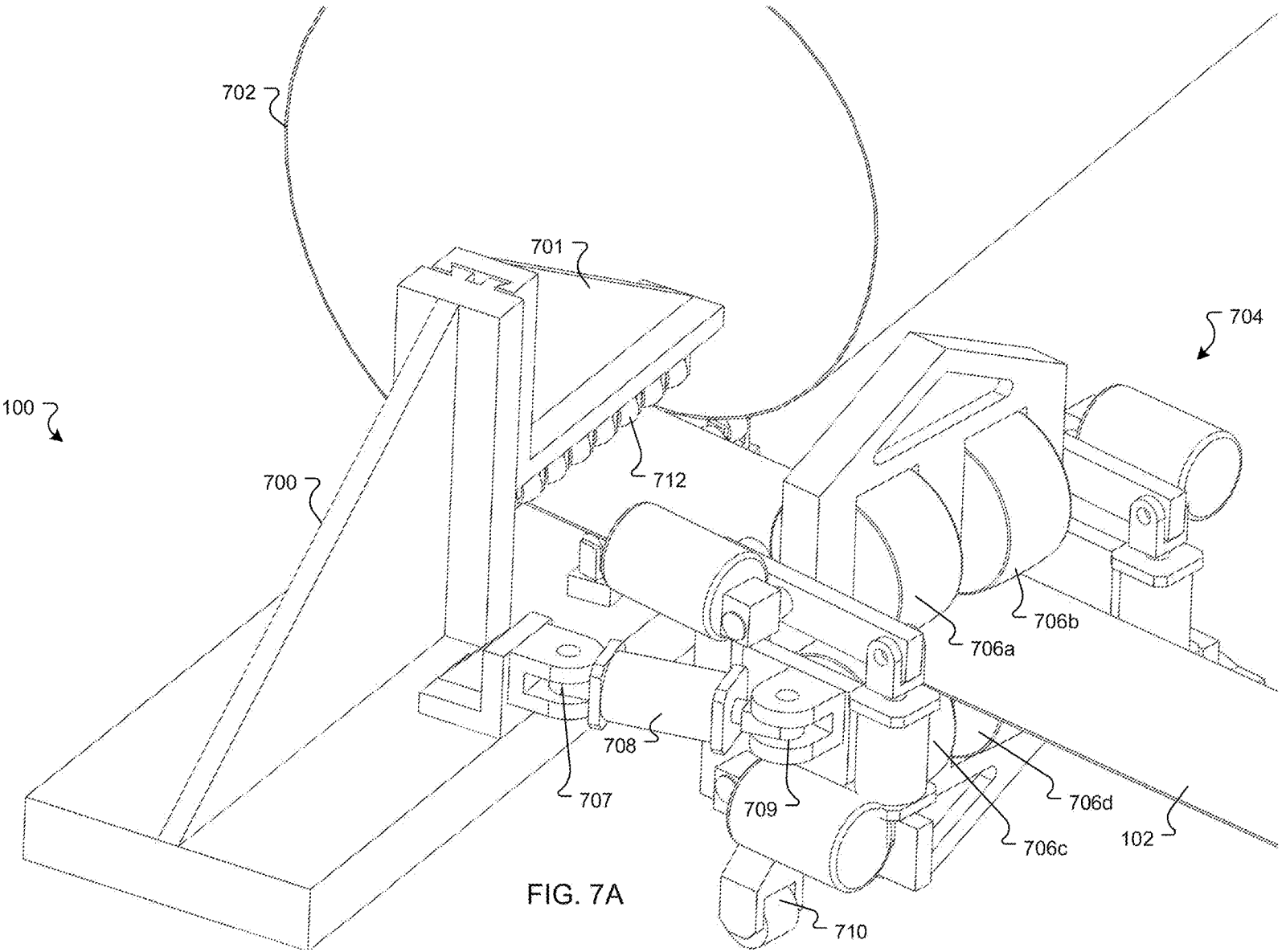
FIG. 7A is a perspective view of a construction system.
Figure 7B:
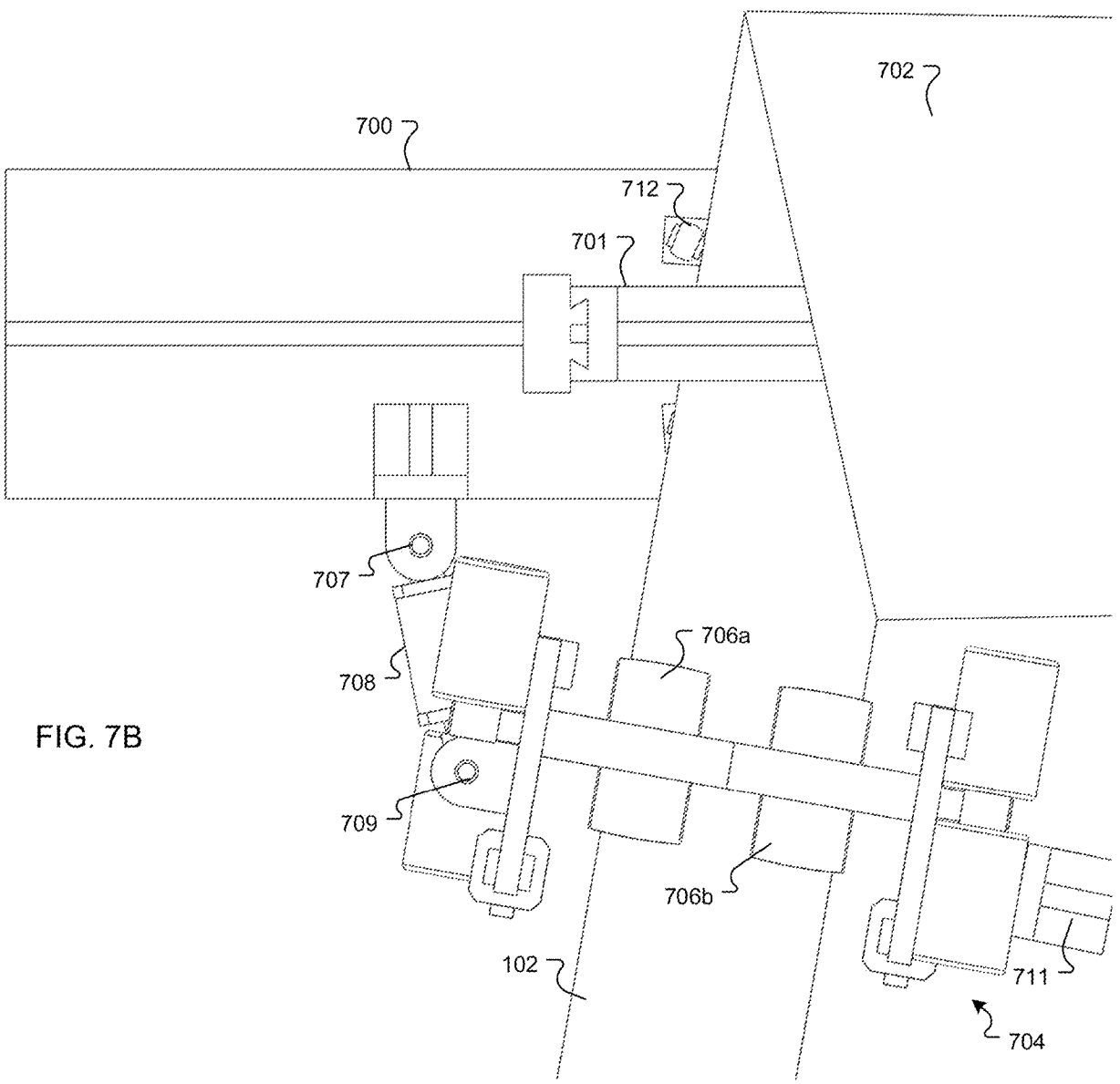
FIG. 7B is an overhead view of a construction system.

FIG. 7A is a perspective view of an implementation of a construction system, and FIG. 7B is a corresponding top view of the implementation.

In some embodiments, the curving device includes a triple roll 700. The triple roll includes a top portion 701 that can be articulated vertically—either manually, or under the direction of the control system 110 (FIG. 1). Articulating the top portion can be useful to engage the stock 102, or to control the amount of curvature imparted to stock 102 as it passes through the triple roll 700. In general, a different portion can be articulated; any controllable change in the relative position of the rolls can be used impart corresponding amounts of curvature to the stock 102.

In some implementations, the triple roll 700 includes a plurality of individual rollers 712 arranged in banks. In various implementations, these rollers 712 can be individually driven, driven collectively, or not driven at all. The banks need not be parallel.

In some embodiments, the feed system 104 (FIG. 1) includes the drive system 704. This drive system includes a plurality of rollers 706*a*, 706*b*, 706*c*, 706*d*, a positioner 708, and wheels 710. The rollers 706*a-d* can be individually driven by the control system 110 (FIG. 1). In particular, the rollers 706*a-d* can be differentially driven (e.g., with rollers 706*a*, 706*c* being driven at a different rate than rollers 706*b*, 706*d*) so as to cause the stock to rotate 102 as it passes through the rollers 706*a-d*. Controlling the rollers' rotational speed (in combination with other parameters described herein) can help implement rotational motion of the stock 102 about the peak of the frusto-conical structure 702.

The drive system 704 is coupled to the triple roll 700 (or other convenient object) via a positioner 708. The positioner 708 is operable to move the drive system 704 (and with it, the stock 102) relative to the triple roll 700, under the direction of the control system 110 (FIG. 1). The positioner 708 can include a hydraulic piston, pneumatic piston, servo, screw, actuator, rack and pinion, cable and pulley system, cam, electromagnetic drive, or other device capable of imparting the desired motion.

In some implementations the drive system 704 is rotatably secured about a pivot point 711, such that activating the positioner 708 causes rotation about the pivot point. In some implementations, the drive system 704 includes wheels 710 to allow the system 704 to move more easily.

Controlling the motion of the drive system 704 via the positioner 708 (in combination with other parameters described herein) can help implement rotational motion of the stock 102 about the peak of the frusto-conical structure 702 during the construction process.

Figure 8A:
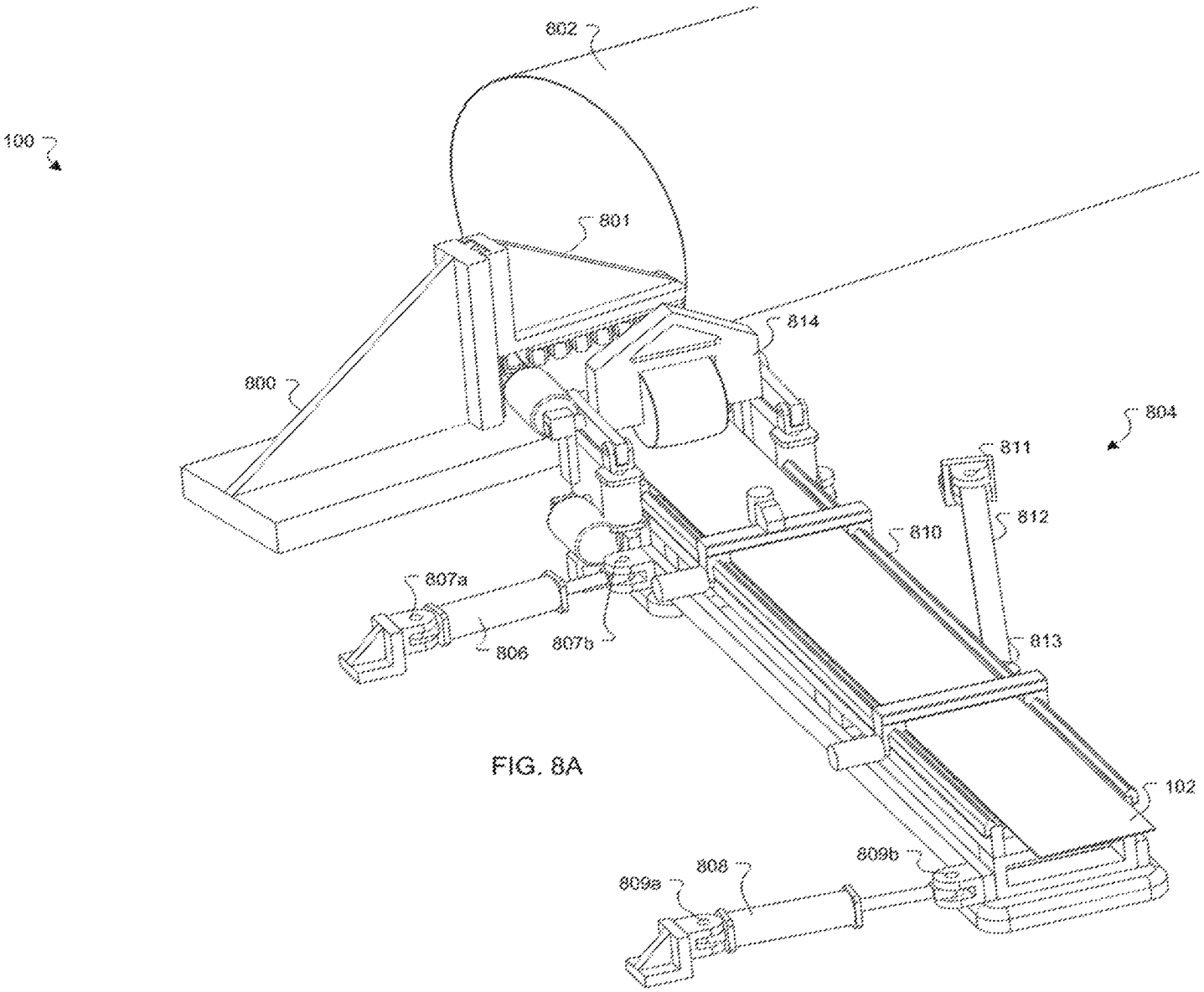
FIG. 8A is a perspective view of a construction system
Figure 8B:
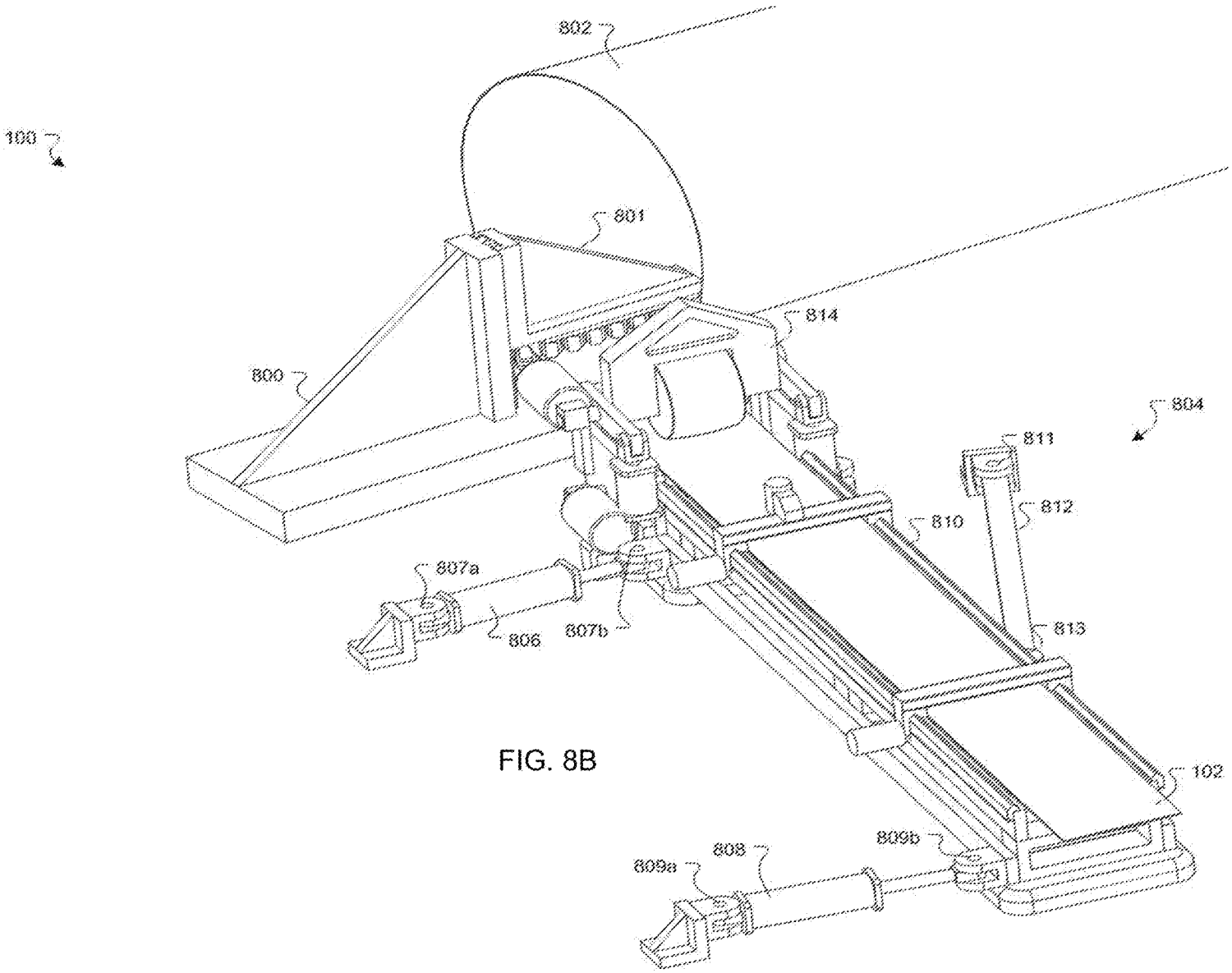
FIG. 8B is an overhead view of a construction system.

FIG. 8A is a perspective view of another embodiment of the construction system 100, and FIG. 8B is a corresponding overhead view of the embodiment. This embodiment includes a triple roll 800 having a top portion 801 as described above and a drive system 804.

The drive system 804 includes two positioners 806, 808 that are rotatably coupled to the ground (or other convenient object) at joints 807*a*, 809*a*, and rotatably coupled to a table 810 at joints 807*b*, 809*b*. As above, the positioner can include a piston, servo, screw, actuator, cam, electromagnetic drive, or other device capable of imparting desired motion. The tension bar 812 is pivotably mounted to the table 810 at joint 813 and pivotably mounted to the ground (or other convenient object) at joint 811. The tension bar 812 biases the table 810 against the positioners 806, 808 and drive system 804.

In some implementations, the table 810 includes features to guide or otherwise help the stock 102 move on the way to the triple roll. For example, the table 810 may include one or more rollers 814, air bearings, electromagnetic systems, low-friction coatings or treatments, wheels, ball transfers, etc.

Each positioner 806, 808 is controlled by the control system 110, which results in motion of the table 810 (and the stock 102). A variety of motions are possible. For example, activating one positioner (and not the other) results in rotation of the table 810 about the joint where the unactivated positioner meets the table. Activating both positioners 806, 808 to move in parallel directions at the same rate translates the table 810 parallel to the direction of motion. Activating both positioners at different rates or in different directions produces a mixed translational/rotational motion. Controlling this motion (in combination with other parameters described herein) can help implement rotational motion of the stock 102 about the peak of the frusto-conical structure 802.

Figure 9A:
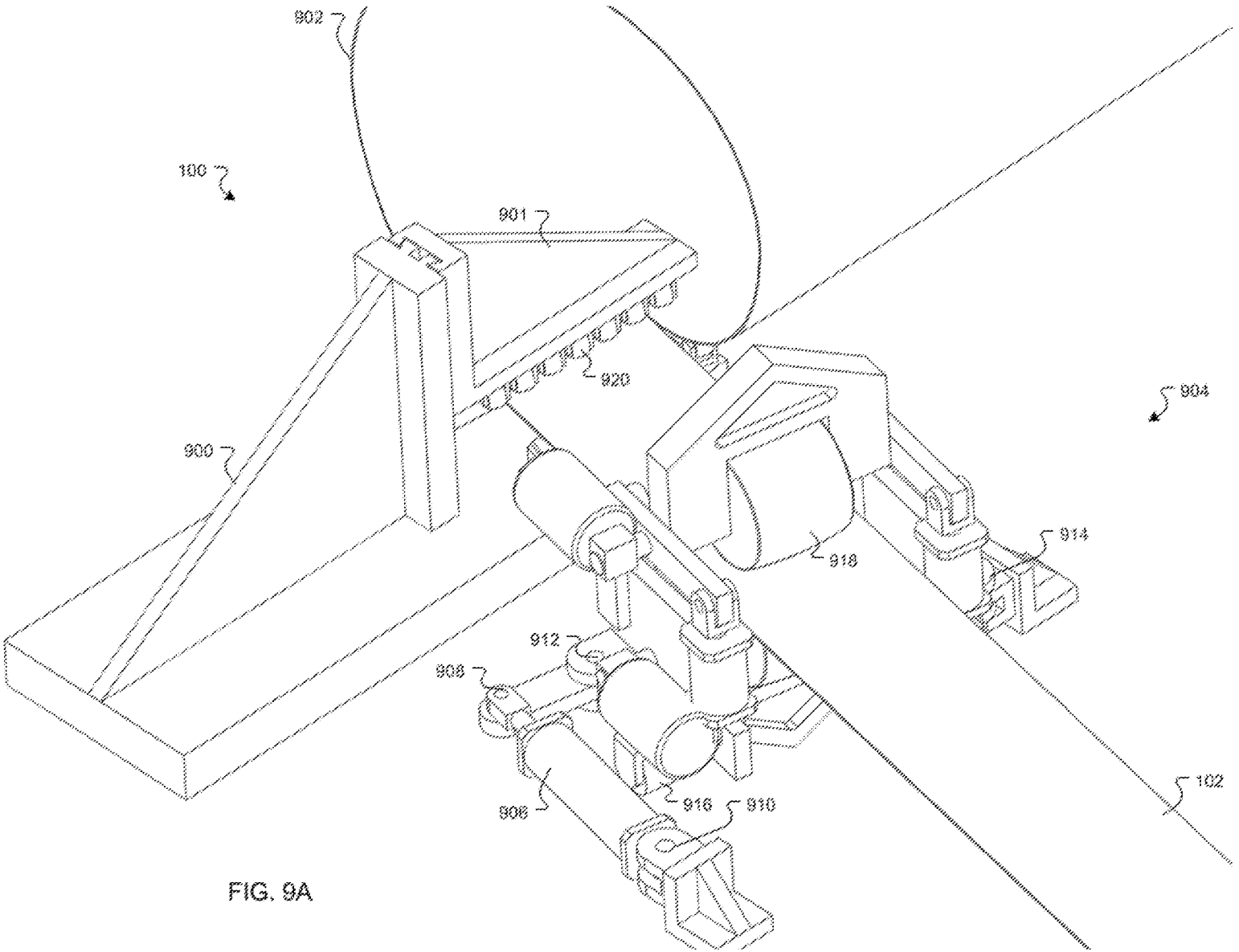
FIG. 9A is a perspective view of a construction system
Figure 9B:
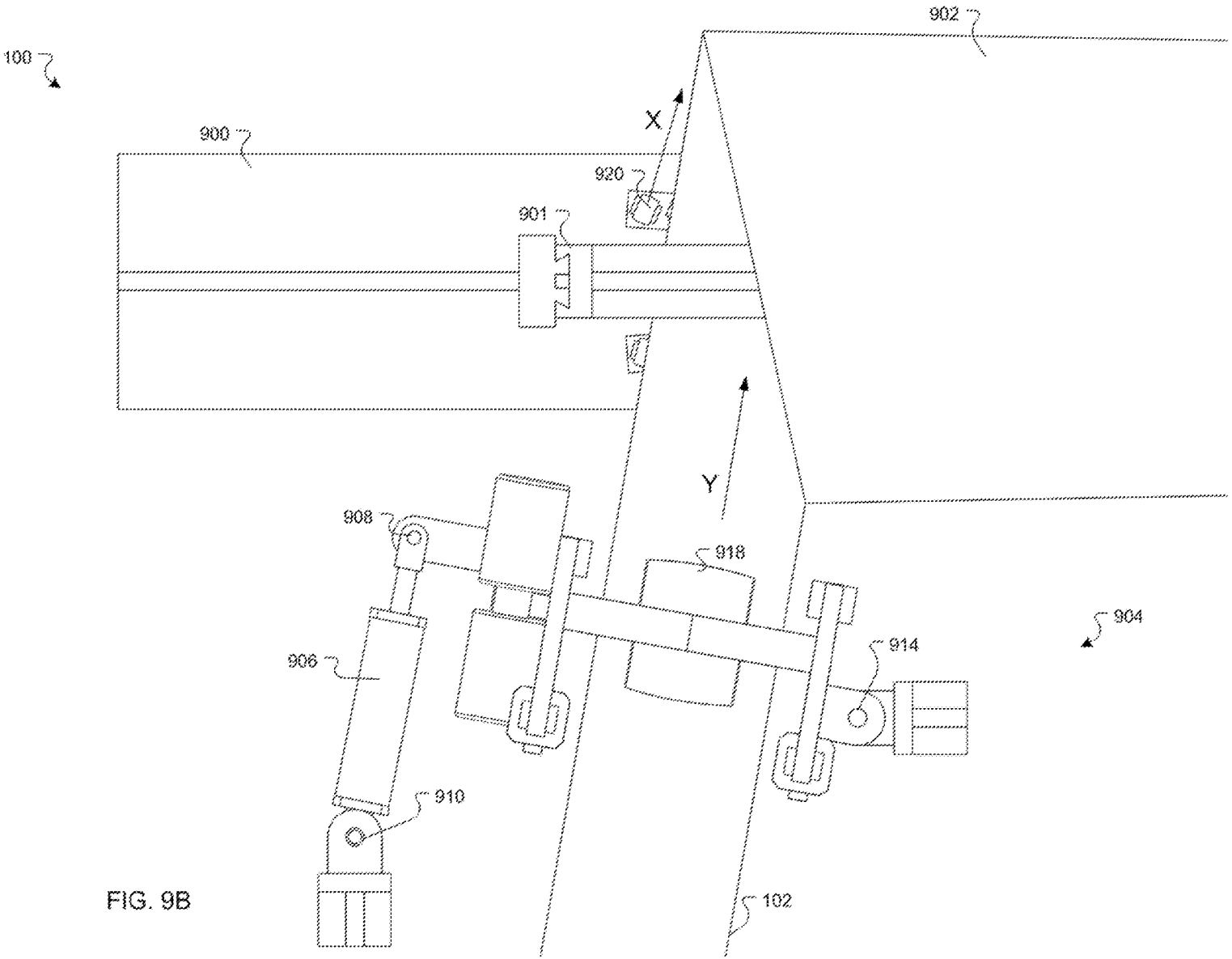
FIG. 9B is an overhead view of a construction system.

FIG. 9A shows a perspective view, and FIG. 9B a corresponding overhead view, of another implementation of a construction system. In some implementations, the triple roll 900 includes a plurality of individual rollers 1200 arranged in banks, as described above. The banks need not be parallel. As described below, the rollers 1200 are individually steerable.

In some implementations, the feed system 104 (FIG. 1) includes the drive system 904. This drive system 904 includes a roller 918, a positioner 906, and a wheel 916. The positioner 906 is rotatably mounted to the drive system 904 at a joint 908, and rotatably mounted to the ground (or other convenient object) at joint 910. The roller 918 is activated by the control system 110 (FIG. 1) so as to drive (i.e., translate) the stock towards the triple roll 900.

The positioner 906 is operable to rotate the drive system 904 (and with it, the stock 102) relative to the triple roll 900, under the direction of the control system 110 (FIG. 1). The positioner 906 can include a hydraulic piston, pneumatic piston, servo, screw, actuator, rack and pinion, electromagnetic motor, cable and pulley system, or other device cam, electromagnetic drive, capable of imparting the desired motion.

Note, however, that the center of this rotation is joint 914, which in general is not the location of the peak of the frusto-conical structure.

To help the stock rotate about the peak of the frusto-conical structure, the individual rolls 1200 of the triple roll can be controlled in various ways. In some implementations, the individual rolls 1200 can be steered by the control system. That is, direction motion imparted to the stock by the rolls 1200, represented by arrow X in FIG. 9B, is controllable, by rotating the individual rolls 1200 with respect to the triple roll chasis. In particular, the direction of arrow X can be made to be different from the feed direction—that is, the direction motion imparted by the roller 918 represented by the arrow Y in FIG. 9B.

In some implementations, the rolls 1200 are fixedly mounted to impart a direction of motion other than the feed direction, but the rotational speed of the rolls 1200 is controllable. In some implementations, controlling the relative speeds of the rolls 918 and 1200 can collectively impart rotational motion of the stock about the peak of the frusto-conical structure.

Figure 10A:
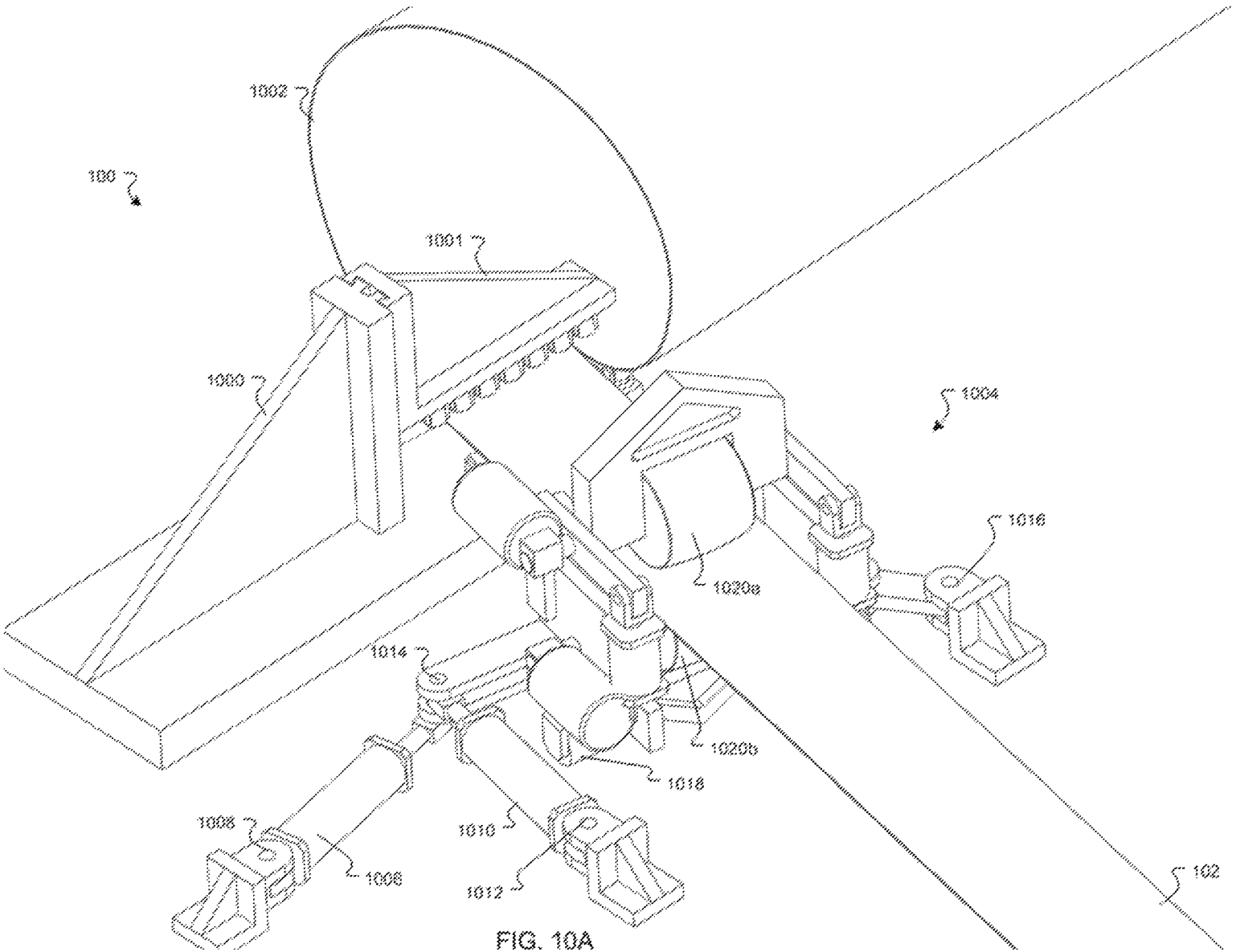
FIG. 10A is a perspective view of a construction system
Figure 10B:
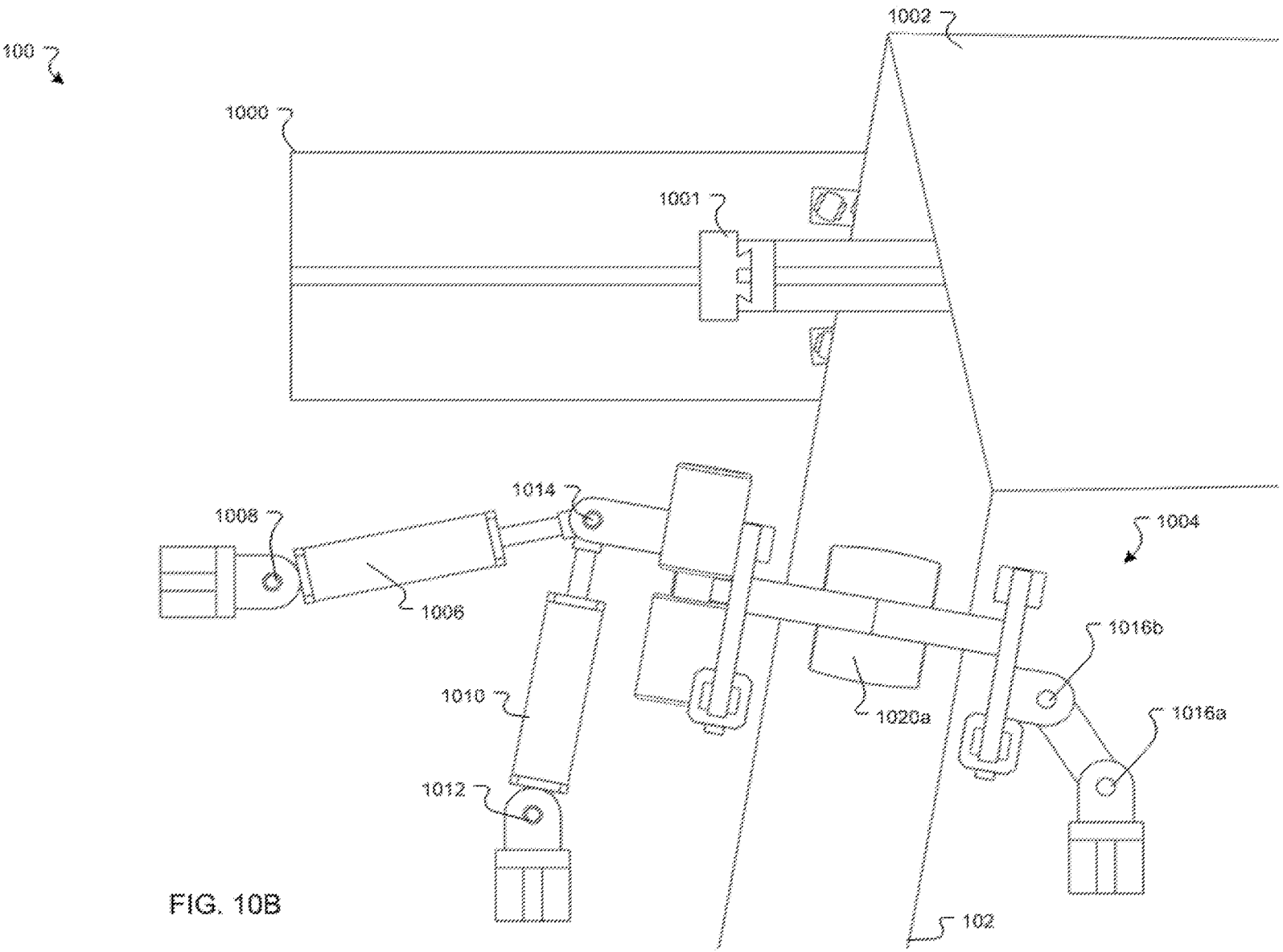
FIG. 10B is an overhead view of a construction system.

FIG. 10A is a perspective view of another implementation of the construction system 100, and FIG. 10B is a corresponding overhead view of the implementation. This implementation includes a triple roll 1000 having a top portion 1001 as described above and a drive system 1004.

The drive system 1004 includes two positioners 1006, 1010 that are coupled, respectively, to the ground (or other convenient object) at joints 1008, 1012, and are each coupled to the drive system 1004 at joint 1014. As above, the positioners can include a piston, servo, screw, actuator, cam, electromagnetic drive, or other device capable of imparting desired motion.

The drive system 1004 also includes a pair of rolls 1020*a*, 1020*b* that are controllable by control system 110. These rolls are operable to drive (i.e., translate) the stock 102 towards the triple roll 1000. Additionally, each positioner 1006, 1010 is controlled by the control system 110, which results in motion of the rolls 1020*a*, 1020*b* (and in some implementations, the stock 102). A variety of motions are possible, from pure translation, to pure rotation, to mixed translational/rotational motion. Controlling this motion (in combination with other parameters described herein) can help implement rotational motion of the stock 102 about the peak of the frusto-conical structure 802.

Figure 11A:
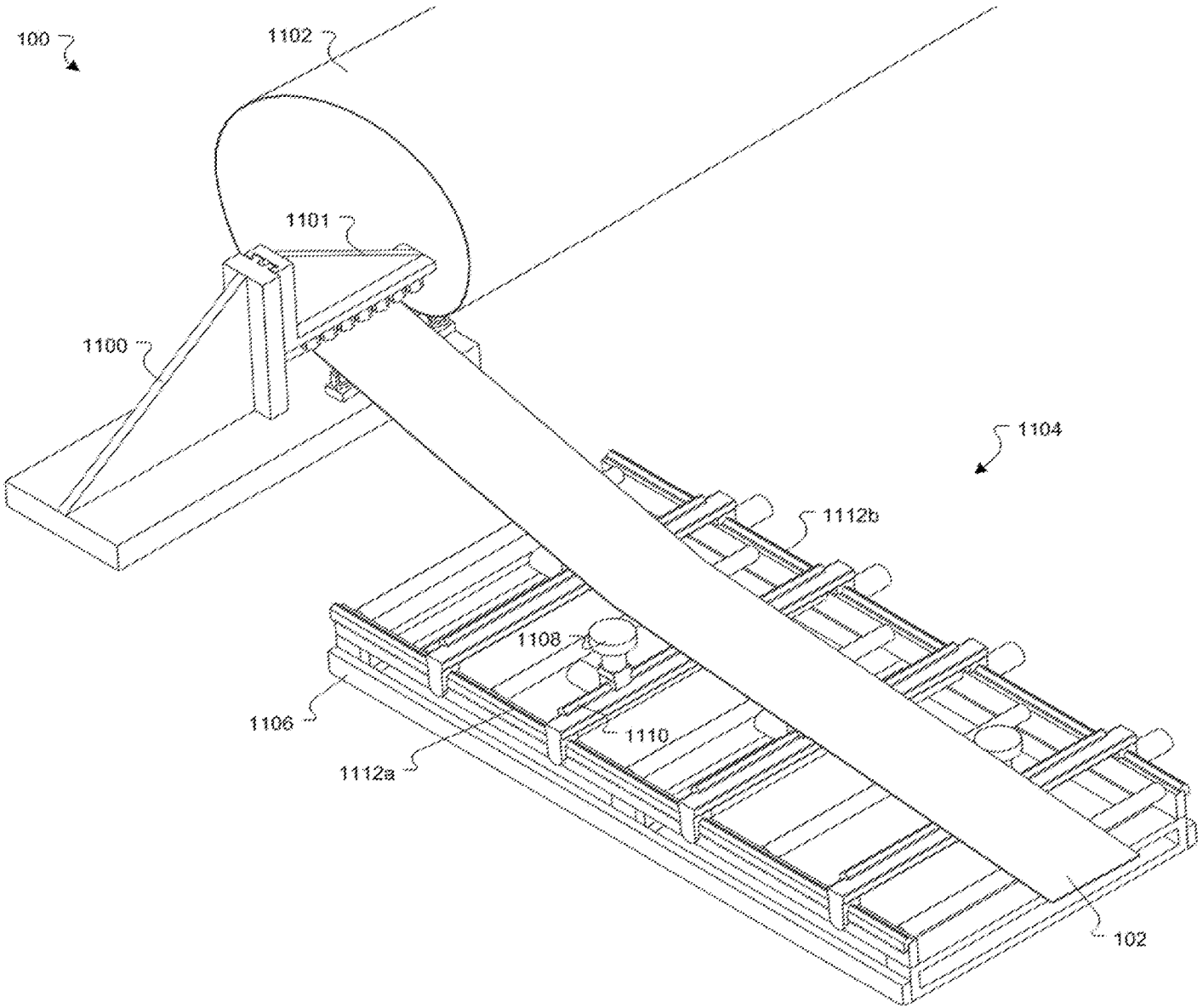
FIG. 11A is a perspective view of a construction system
Figure 11B:
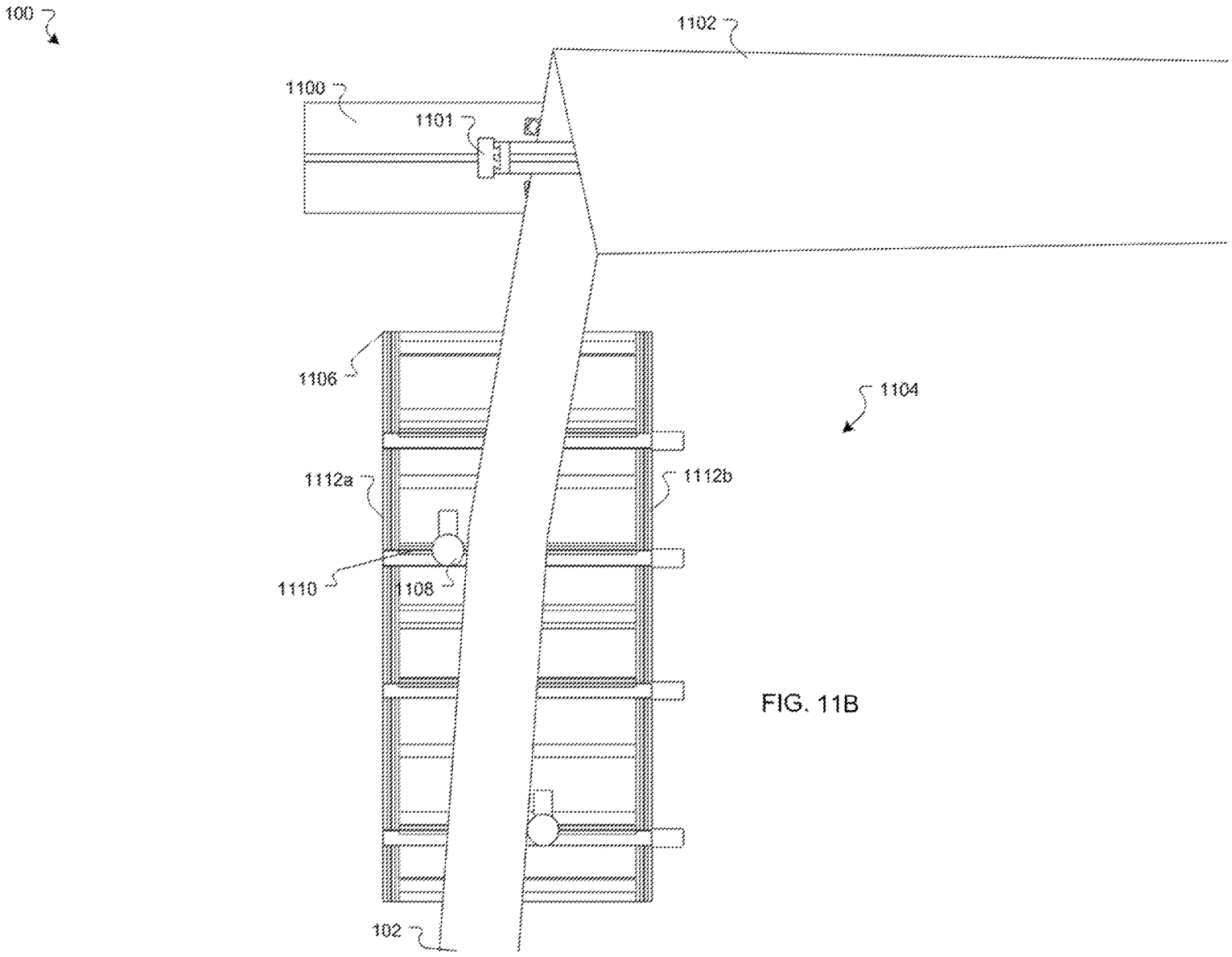
FIG. 11B is an overhead view of a construction system.

FIG. 11A is a perspective view of another implementation of a construction system, and FIG. 11B is the corresponding overhead view of the implementation.

Here, the construction system includes a triple roll 1100 with a controllable top portion as described above that deforms stock 102 into a frusto-conical structure 1102. The feed system 104 includes a drive system 1104. The drive system includes an assembly 1106 having two or more pickers 1108. Each picker 1108 is slidably mounted on a rail 1110, and each rail 1110 is slidably mounted on two tracks 1112*a* and 1112*b*. Under the control of the control system 110, the pickers may be positioned at any desired location within the accessible area defined by the rail 1110 and the tracks 1112*a,b*.

Each picker 1108 is operable to engage, grasp, or otherwise adhere to the stock 102. In some implementations, a picker 1108 can include controllable electromagnets, suction devices, clamps, flanges, adhesives, or the like. In some implementations, robotic arms may be employed in place of the assembly 1106 to move the pickers 1108 to desired locations.

Complicated motions (including rotations and/or translations) can be imparted to the stock by engaging, grasping, or otherwise adhering to the stock at two or more points. In particular, using the pickers 1108 in this fashion can help implement rotational motion of the stock 102 about the peak of the frusto-conical structure.

Figure 12:
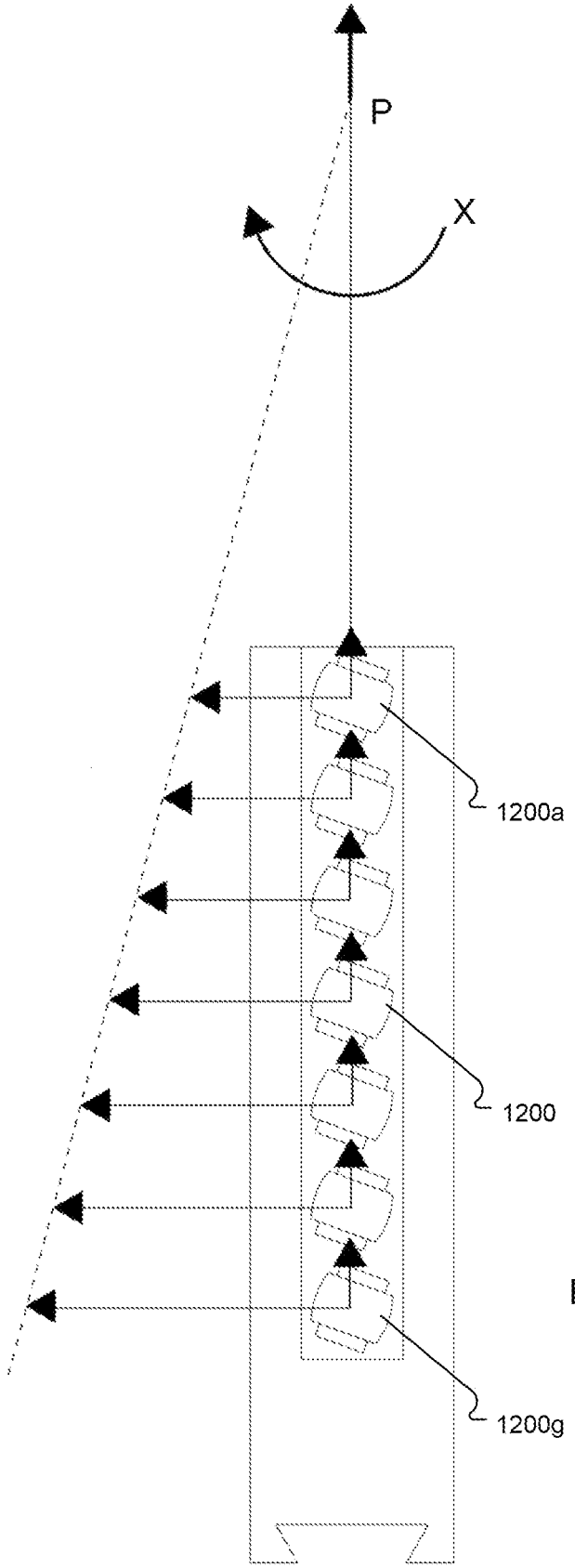
FIG. 12 is a schematic depiction of a bank of rollers.

FIG. 12 shows a schematic view of a single bank of rolls in a triple roll, consistent with another implementation of the construction system. In FIG. 12, the arrows on each individual roll 1200 represents a component of motion imparted to the stock by the roll 1200 as the stock passes over the roll. Each arrow is a function of the roll's orientation and rate at which the roll is driven. Thus, for example, roll 1200*a* imparts relatively little horizontal motion to the stock at the location of roll 1200*a*, while 1200*g* imparts a relatively large amount of horizontal motion at the location of 1200*g*.

With exactly two differentially driven rolls 1200, a rotational component (or a mixed rotational/translational component) can be imparted to the stock. With more than two rolls 1200, it is desirable to arrange for each roll to consistently impart the same bulk motion to the stock. For example, for implementing a rotational motion in the direction of arrow X about a peak location P (which itself is moving vertically), each roll 1200 is configured to impart vertical motion identical to P's vertical motion, and a degree horizontal motion that linearly increases (as shown by the dashed line) with the roller's distance from P.

The foregoing exemplary implementations used various structures—positioners, single rollers, pairs or systems of differentially driven rollers, pickers, etc.—to move the stock or contribute to moving the stock such that the net result is the stock moving rotationally with respect to the peak as it moves through the curving device. These exemplary implementations illustrate only a few of the virtually infinite number of possibilities for accomplishing this result. In particular, the foregoing implementations do not exhaustively illustrate the full scope of the invention.

Figure 13:
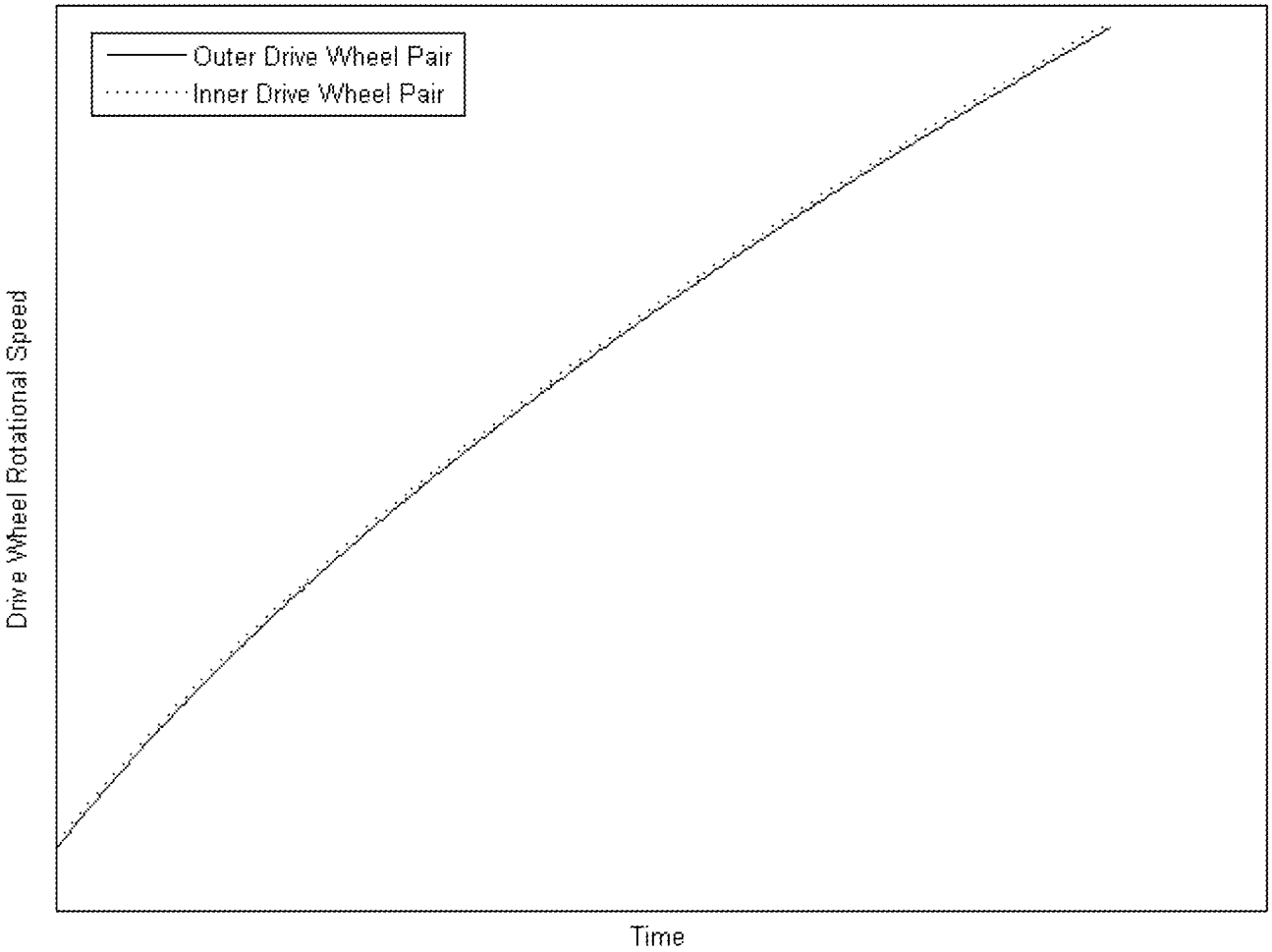
FIG. 13 is a graph.

Moreover, even for a specific configuration of equipment, in general there may be more than one way to control the various components so the net effect is to rotationally move the stock about the peak on the stock's way to the curving device. The graph shown in FIG. 13 illustrates a particular control scenario in the context of implementations consistent with FIG. 7. When the rotation speeds of an outer drive wheel pair (e.g., rollers 706*a*, 706*c*) and an inner drive wheel pair (e.g., rollers 706*b*, 706*d*) vary as shown in FIG. 13, rotational motion about the peak location is achieved.

Other control techniques are readily identifiable.

Figure 14:
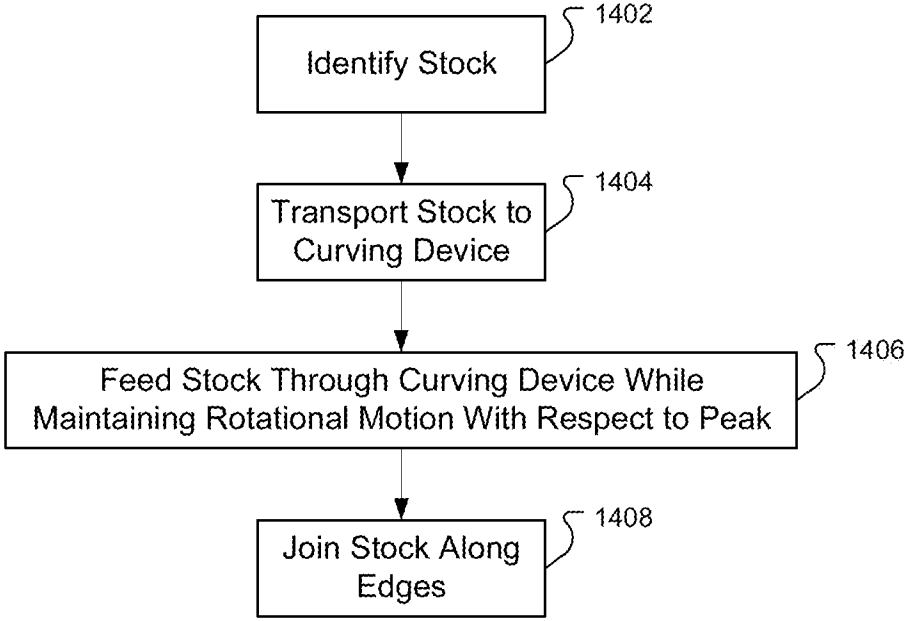
FIG. 14 is a flowchart.

FIG. 14 is a flowchart showing a method for constructing a tapered structure in accordance with each of the foregoing implementations. In step 1402, stock is identified. As discussed above, in some implementations the stock can include a roll of metal or other material. In some implementations the stock comprises pre-cut individual sheets, as described in U.S. patent application Ser. No. 12/693,369.

In step 1404 the stock is transported to the curving device. This may occur using any known means. In particular, there is no constraint on the stock's motion in this step, and it need not rotate with respect to any other point.

In step 1406, the stock is fed into the curving device. In this step, the stock maintains rotational motion with respect to the peak of the frusto-conical structure during the in-feed process. Step 1406 results in deforming the stock to impart a certain degree of curvature. However, in some implementations, no in-plane deformation of the stock occurs.

In step 1408, edges of the stock are joined together where they meet, so as to form the tapered structure. In some implementations, a separate joining step may occur before step 1406. For example, for trapezoidal shaped sheets of stock having a pair of long sides and a pair of short sides, the short sides may be joined first (e.g., with other sheets of stock), then the stock deformed, and then the long sides joined.

Joining the stock can be accomplished by any known means, including welding, adhesives, epoxy, cement, mortar, rivets, bolts, staples, tape, brazing, soldering, or complementary geometric features (e.g., pins that mate with holes, teeth that mate with each other, snaps, etc.

The above systems, devices, methods, processes, and the like may be realized in hardware, software, or any combination of these suitable for the control, data acquisition, and data processing described herein. This includes realization in one or more microprocessors, microcontrollers, embedded microcontrollers, programmable digital signal processors or other programmable devices or processing circuitry, along with internal and/or external memory. This may also, or instead, include one or more application specific integrated circuits, programmable gate arrays, programmable array logic components, or any other device or devices that may be configured to process electronic signals. It will further be appreciated that a realization of the processes or devices described above may include computer-executable code created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software. At the same time, processing may be distributed across devices such as the various systems described above, or all of the functionality may be integrated into a dedicated, standalone device. All such permutations and combinations are intended to fall within the scope of the present disclosure.

In some embodiments disclosed herein are computer program products comprising computer-executable code or computer-usable code that, when executing on one or more computing devices (such as the devices/systems described above), performs any and/or all of the steps described above. The code may be stored in a non-transitory fashion in a computer memory, which may be a memory from which the program executes (such as random access memory associated with a processor), or a storage device such as a disk drive, flash memory or any other optical, electromagnetic, magnetic, infrared or other device or combination of devices. In another aspect, any of the processes described above may be embodied in any suitable transmission or propagation medium carrying the computer-executable code described above and/or any inputs or outputs from same.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The meanings of method steps of the invention(s) described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

Thus for example, a description or recitation of "adding a first number to a second number" includes causing one or more parties or entities to add the two numbers together. For example, if person X engages in an arm's length transaction with person Y to add the two numbers, and person Y indeed adds the two numbers, then both persons X and Y perform the step as recited: person Y by virtue of the fact that he actually added the numbers, and person X by virtue of the fact that he caused person Y to add the numbers. Furthermore, if person X is located within the United States and person Y is located outside the United States, then the method is performed in the United States by virtue of person X's participation in causing the step to be performed.

What is claimed is:

1. An apparatus for producing a frusto-conical structure, the apparatus comprising:

a feed system operable to move a sheet of material in a first direction;

a curving device operable to:

receive the sheet of material from the feed system, move the sheet of material in a second direction different from the first direction, and curve the sheet of material to form the frusto-conical structure; and a control system in communication with the feed system and the curving device, the control system configured to control the feed system and the curving device such that a portion of the sheet of material that has not yet been curved by the curving device is maintained at a substantially constant distance from a predetermined virtual peak of the frusto-conical structure as the sheet of material is moved into the curving device, the predetermined virtual peak located at a point where a taper of the frusto-conical structure would decrease to zero if the frusto-conical structure were not truncated.

2. The apparatus of claim 1, further comprising the sheet of material, wherein the sheet of material includes a metal sheet.

3. The apparatus of claim 2, wherein the sheet of material comprises a trapezoidal sheet.

4. The apparatus of claim 1, wherein the feed system is configured to drive the sheet of material in the first direction towards the curving device.

5. The apparatus of claim 4, wherein the feed system comprises a roller operable to translate the sheet of material in the first direction.

6. The apparatus of claim 1, wherein the feed system is adjustable in two degrees of freedom to position the sheet of material relative to the curving device.

7. The apparatus of claim 1, wherein the feed system is operable to rotate the sheet of material relative to the curving device.

8. The apparatus of claim 1, wherein the curving device comprises a triple roll.

9. The apparatus of claim 8, wherein the triple roll comprises a plurality of rollers arranged in a bank.

10. The apparatus of claim 9, wherein the plurality of rollers is steerable to move the sheet of material in the second direction.

11. The apparatus of claim 1, wherein the portion of the sheet of material that has not yet been curved by the curving device is a first portion, and wherein the apparatus further comprises a welder controllable to join a second portion of the sheet of material that has been curved by the curving device with another portion of the frusto-conical structure that has been curved by the curving device.

12. An apparatus for producing a frusto-conical structure, the apparatus comprising:

a feed system comprising a roller operable to drive a metal sheet in a first direction, the feed system adjustable in two degrees of freedom to position the metal sheet;

a curving device comprising a triple roll, the triple roll including a plurality of steerable rollers arranged in a bank, the plurality of steerable rollers operable to:

receive the metal sheet from the feed system, move the metal sheet in a second direction different from the first direction, and curve the metal sheet to form the frusto-conical structure;

a welder operable to join the metal sheet to itself or to other metal sheets; and a control system in communication with the feed system, the curving device, and the welder, the control system configured to:

control the feed system and the curving device such that, as the metal sheet is driven into the curving device, a first portion of the metal sheet that has not yet been curved by the curving device is maintained at a substantially constant distance from a predetermined virtual peak of the frusto-conical structure, the predetermined virtual peak located at a point where a taper of the frusto-conical structure would decrease to zero if the frusto-conical structure were not truncated, and control the welder to join a second portion of the metal sheet that has been curved by the curving device with another portion of the frusto-conical structure that has been curved by the curving device.

13. An apparatus for producing a frusto-conical structure, the apparatus comprising:

a feed system operable to move a sheet of material in a first direction;

a curving device operable to:

receive the sheet of material from the feed system, move the sheet of material in a second direction different from the first direction, and curve the sheet of material to form the frusto-conical structure; and a control system in communication with the feed system and the curving device, the control system configured to control the feed system and the curving device in a manner such that a portion of the sheet of material that has not yet been curved by the curving device is rotated about a predetermined virtual peak at a substantially constant radial distance from the predetermined virtual peak as the sheet of material is moved into the curving device, the predetermined virtual peak located at a point where a taper of the frusto-conical structure would decrease to zero if the frusto-conical structure were not truncated.

* * * * *